United States Patent [19]

Perna et al.

[11] Patent Number: 4,982,350

[45] Date of Patent: Jan. 1, 1991

[54] SYSTEM FOR PRECISE MEASUREMENT OF TIME INTERVALS

[75] Inventors: Nicholas A. Perna, Eltoro; Norman C. Walker, Solana Beach, both of Calif.

[73] Assignee: Odetics, Inc., Anaheim, Calif.

[21] Appl. No.: 60,727

[22] Filed: Jun. 10, 1987

[51] Int. Cl.[5] ..... G04F 10/00

[52] U.S. Cl. ..... 364/569; 368/121

[58] Field of Search ..... 364/550, 569, 571; 371/15, 18, 20; 73/861.27; 341/120, 157; 340/870.21, 870.31; 368/113, 121; 324/78 E

[56] References Cited

U.S. PATENT DOCUMENTS

| | | | |
|---|---|---|---|
| 3,731,195 | 5/1973 | Wessel | 368/121 |
| 3,961,258 | 6/1976 | Morisaki | 368/121 |
| 3,983,481 | 9/1976 | Nutt et al. | 324/78 J |
| 3,999,128 | 12/1976 | Janowitz et al. | 324/78 E |
| 4,301,360 | 11/1981 | Blair | 368/121 |
| 4,349,821 | 9/1982 | Vancsa | 340/870.21 |
| 4,468,746 | 8/1984 | Davis | 364/569 |
| 4,471,452 | 9/1984 | Borchert | 364/569 |
| 4,519,091 | 5/1985 | Chu | 377/44 |
| 4,523,289 | 6/1985 | Soma et al. | 364/569 |
| 4,554,636 | 11/1985 | Maggi et al. | 364/481 |
| 4,613,950 | 9/1986 | Knierim et al. | 364/569 |
| 4,613,951 | 9/1986 | Chu | 364/569 |
| 4,630,224 | 12/1986 | Sollman | 364/481 |
| 4,725,968 | 2/1988 | Baldwin et al. | 364/550 |

OTHER PUBLICATIONS

IEEE Trans Nuclear Science; Feb. 1980 (VNS-27, N1); "Space Borne Event Timer"; B. Turko; pp. 399–404.

Med & Biol Eng & Comp; Nov. 1980 (V18, N6); "High Resolution Interval Timer . . . "; C. J. Robinson et al.; pp. 730–740.

Elec. Design; Jul. 22, 1982 (V30, N15); "Time Window Nails Down D-A Converter's Settling Time"; S. Mohr et al.; pp. 153–160.

Pribery I. Teknika Eksperimenta (Translated); Mar. 1979; "High Speed Device for Time Interval Measurement"; E. I. Kovrigin et al.; pp. 484–486.

IBM Tech Disc.; May 1978 (V. 20, N. 12); "High Resolution Programmable Cycle Timer"; C. King; pp. 5135–5136.

Kode (Div. of Odetics) Sales Brochure & Manual, for Kode TIA 2001 Time Interval Analyzer.

*Primary Examiner*—Kevin J. Teska

*Attorney, Agent, or Firm*—Spensley Horn Jubas & Lubitz

[57] ABSTRACT

An integrated system for precise measurement of time intervals wherein a high resolution and accuracy can be achieved through the implementation of an interpolation function and a self calibration function. The interpolation function scales down a relatively coarse major time base to a finer time base for the portions near the boundaries of the time interval that is being measured. The calibration function is built into the system for facilitating calibration of the interpolation function under actual operating of the system.

18 Claims, 13 Drawing Sheets

SYSTEM FOR PRECISE MEASUREMENT OF TIME INTERVALS

BACKGROUND OF THE INVENTION

1. Field of the Invention

The present invention relates to a system for measuring time intervals and more particularly to the implementation of an interpolation function and a calibration function for facilitating precise measurement of time intervals. Still more particularly, the present invention is directed to an integrated system in which the calibration function is provided by built-in integrated hardware.

It is desirable to measure precise time intervals, for example, in connection with the design, testing and trouble shooting of magnetic disk drives. Typically in magnetic recording using a disk drive, data is recorded in the form of digital bits (logic 1's and 0's) encoded in time dependent format such as modified frequency modulation (MFM) format. In order to analyze the performance of a disk drive, it is necessary to precisely evaluate the effect of bit jitter, peak shift, and read margin on data detection in a data recovery process. In particular, peak shift and jitter correspond to fluctuations in the positions of the data bits from their nominal positions, and read margin is related to the boundary within which the data bits can be properly detected even when there are such fluctuations in data bit positions in the data stream. These factors are all related to the phase or timing of the data bits. By measuring the precise time intervals between data bits, the extent of the effects of the aforementioned factors may be determined. For a 50 MHz disk drive system, the nominal time interval between data bits is in the order of 20 ns and the time representative of the fluctuations from the mean may be in the order of 10 ns. Thus, the resolution of a time interval measurement device applied to analyze the disk drive should be in the order of 100 ps in order for the device to be able to accurately determine the size of the fluctuations.

2. Description of the Prior Art

The operation of a prior art time interval measurement device will be described with reference to FIGS. 1 and 2. As illustrated in FIG. 1, a time interval L to be measured is defined between edges 10 and 12 of a square pulse 14 in an input signal and is determined by means of counting discrete increments of reference pulses as identified by the rising edges 16 in a reference signal, which is generated by a system clock, occurring between the beginning (edge 10) and end (edge 12) of the time interval L. The clock has a precise frequency and the period T or time base of the clock is known. The input signal is typically asynchronous to the clock signal, as the input signal is sampled with the clock already running in a stabilized state.

Referring to FIG. 2, typically the input signal is monitored by an edge detector 18 which detects the transitions from logic 1 to 0 or vice versa at the boundaries 10 and 12 of the input pulse 14 and determines whether a detected transition is a rising (logic 0 to 1) or a falling (logic 1 to 0) edge. When a transition edge is detected, a controller 20 starts or stops a counter 21 by producing a start or stop trigger, respectively, depending on the predetermined response of the controller to the two types of transition edges. For example, FIG. 1 shows a situation in which the controller produces a start trigger 20 and a stop trigger 24 to start and stop the counter 21 at the rising edge 10 and the falling edge 12, respectively, of the pulse 14. As the counter 21 is triggered to start at the rising edge of the input pulse 14, clock pulses from a system clock 26 increment the counter 21. Typically, the counter 21 is incremented at each rising edge 16 of the clock pulses following the rising edge of the start trigger 22. Hence, each rising edge 16 represents one clock pulse. At the detection of the falling edge 12 of the input signal, the controller 20 stops the counter 21. The count N of the number of rising edges of the clock signal between the start and stop of the counter is representative of the time interval L. The time interval L is approximated by multiplying N by the time base T (i.e. $N \times T$). In the particular example in FIG. 1, there are four increments of clock pulses ($N=4$) during the measured time interval.

The prior art device is subjected to several limitations and drawbacks. For example, the accuracy of the time interval measurements by the prior art device is partly determined by whether an integral number of discrete system clock pulses can fit completely and exactly within the boundaries 10 and 12 of the time interval L. Referring to FIG. 1, because the input signal as shown is asynchronous to the clock signal, the interval time represented by $N \times T$ does not include the time interval A from the start of the interval L to the next rising edge 16 of the clock pulse following the start of the interval L. On the other hand, the same interval time $N \times T$ includes the time interval B from the end of the time interval to the next rising edge 16 of the clock pulse following the end of the interval L. Absent any systematic errors, if A and B are of the same value, there would be no error in the measured interval time as provided by the direct count N of the discrete clock pulses. However, since A and B may be of different lengths, the interval represented by $N \times T$ may be different from the actual time interval L of the input pulse. The difference between the measured and the actual interval time L depends on the values of intervals A and B, or more particularly, on the difference between intervals A and B ($A-B$). This difference could be as large as the period T. The resolution of the time interval measurement described above is thus plus or minus the selected time base T.

Although the resolution and thus the accuracy of the time interval measurements may be improved by choosing a smaller time base, this option is often limited by the frequency capability of available system clocks. Typically, it may be practical to employ in a system a clock which is capable of generating pulses of precise frequency of up to 100 MHz which will provide a 10 ns time base, or resolution. However, in order to achieve a resolution of 100 ps, it would require a precision 10 GHz clock which would substantially increase the complexity of the hardware and the cost of the system, thus rendering the use of such clock impractical.

Aside from using a smaller time base for the system clock, one method of improving the resolution of the time interval measurement described above is to interpolate the values of intervals A and B which correspond to partial clock periods. A time interval measuring device Universal Counter Model HP5334A manufactured by Hewlett Packard, Inc. measures the respective time that is required to recharge a capacitor which was caused to discharge from a predetermined charge level during the periods between the start and end of intervals A and B, respectively. The respective recharging time represents the intervals A and B. The recharging rate used is lower than the discharging rate in order to yield a good resolution. Such device, however, has a relatively long system processing time for each measurement of intervals A and B. Thus the highest available sampling rate of the system is relatively low.

Another limitation of the prior art time interval measurement device is that there is no provision in the device for calibration of the device in its actual operation condition. Typically, a manufacturer of the prior art device calibrates the device for a nominal operating condition, e.g., a nominal operating temperature. The calibration observed at the manufacturer's test bench can be substantially eroded by factors over which the manufacturer has little control once the device leaves the manufacturing plant. For example, in the actual operation of the device, the temperature of the environment can alter the characteristics of the circuit components in the device since the device is typically made up of temperature dependent components. Due to the complex interactions of the temperature dependent components, it would be difficult to determine a fixed offset to compensate for the effect of temperature. Hence it would be necessary to recalibrate the device in the particular environment in which it is used. In addition, it may be necessary to recalibrate the device to remove systematic errors arising from, for example, aging of the components which may cause undesirable delays in the response of the circuit components.

Moreover, the user typically does not have the external equipment necessary for calibration. The device has to be shipped to, for example, the manufacturer for calibration. The down-time of the device would be increased thereby causing inconvenience to the user.

SUMMARY OF THE INVENTION

The present invention is directed to an integrated system for precise measurement of time intervals wherein high resolution and accuracy can be achieved. The present system implements an interpolation function whereby a relatively coarse but accurate major time base is scaled down to a finer time base at the portions near the boundaries of the time interval that is being measured. In connection with the interpolation function, a built-in self calibration function is provided for calibration of the system in its actual operating environment.

For time interval measurements, the major time base is provided by a system clock which generates pulses of a known period. These pulses are used to increment a counter which counts the number of reference edges of the clock pulses occurring within the time interval being measured. The count is represented in digital form. The interpolation function makes use of an interpolator at each boundary of the time interval for determining the time from each boundary to the reference edge of the clock pulse immediately following the respective boundary. Each interpolator scales down the major time base to a smaller time base near each time interval boundary.

In the preferred embodiment, each interpolator employs a linearly decreasing ramp signal of a predetermined slope. Each ramp is triggered to start at the respective time interval boundary. Each ramp signal is stopped and its amplitude measured at the instant a predetermined edge of the clock pulse is encountered following the respective time interval boundaries. The measured ramp signals are representative of the ramp time and hence the time from the boundaries of the time interval to the respective reference edges of the clock pulses immediately following the respective boundaries. Analog-to-digital converters are provided to convert the ramp measurements into digital form. In effect, the digital output of each analog-to-digital converter is a count of a scaled down time base derived from the major time base provided by the system clock. The resolution of the interpolators in time interval measurements is equal to the finer time base. The size of the finer time base provided by each interpolator is determined by the resolution of the respective analog-to-digital converter in the conversion of the ramp measurements from analog to digital form.

The count of the major time base of the system clock pulses and the count of the fine time base measured by each interpolator are combined into a single binary number which is representative of the measured interval time. This number may be converted into time format or stored in memory. Alternatively, if a large sample of time interval measurements were taken wherein some of the time intervals may be of different values, the result of the time interval measurements may be displayed in the form of a probability density function representing the distribution of the occurrences of the different values.

Calibration of the present system includes independent adjustments of the slopes of each ramp signal to obtain a desired full scale ramp outputs and of the reference input voltages to each analog-to-digital converter to obtain a desired range of digital output codes in response to the ramp outputs. A calibration test signal of a precise known frequency is used as a reference input signal and it provides a basis for the above adjustments. In addition, the system measures the widths of the pulses in the test signal to determine the overall systematic errors in the measurements arising from delays in signal processing and compensates for such errors accordingly by adjusting the offsets of the analog-to-digital converters. The system calibration may be performed in a simple manner by the end user in the actual operating environment of the system. The calibration process may be automated in a system self test mode.

Through the implementation of the interpolation function and he self calibration function, the present system achieves a high resolution and accuracy in time interval measurements.

DESCRIPTION OF THE PREFERRED EMBODIMENT

Figure 1:
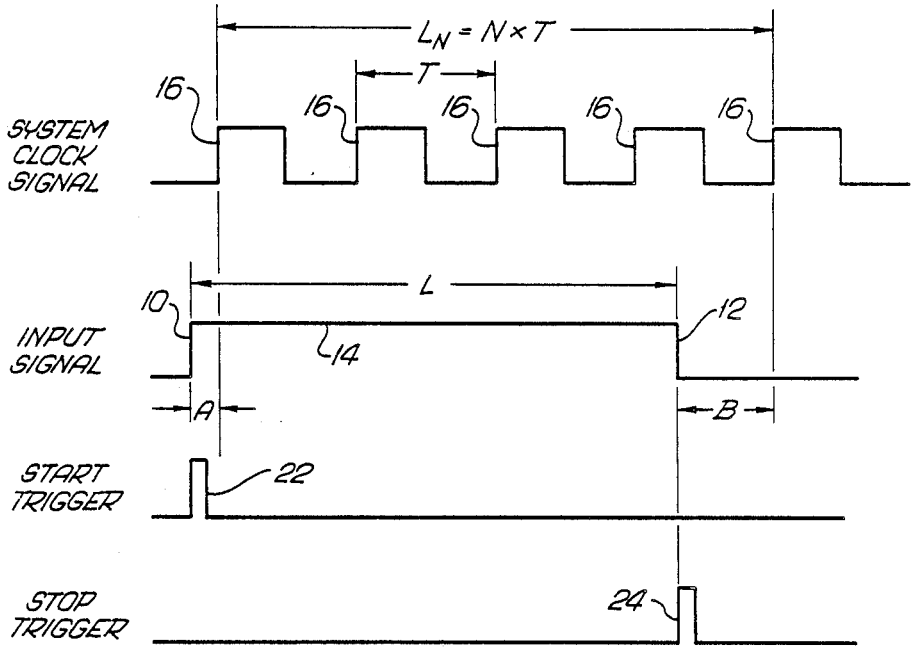
FIG. 1 PRIOR ART
FIG. 1 is an waveform diagram illustrating time interval measurements in a prior art device.
Figure 2:
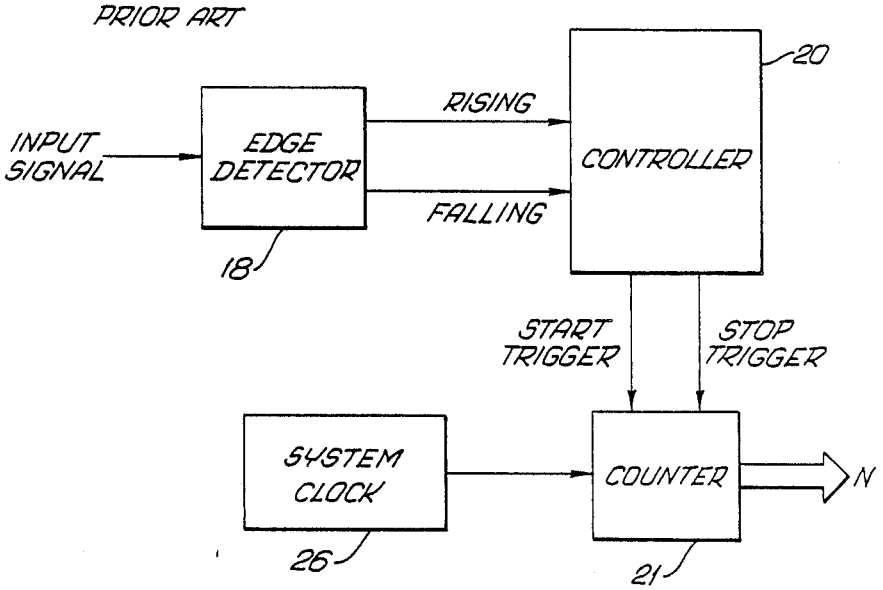
FIG. 2 PRIOR ART
FIG. 2 is s a block diagram of a prior art time interval measurement device.

The following detailed description is of the best presently contemplated mode of carrying out the invention. This description is made for the purpose of illustrating the general principles of the invention and should not be taken in a limiting sense. The scope of the invention is best determined by reference to the appended claims.

Referring to FIG. 3A, a system clock provides a coarse time base T as a major time base for time interval measurements. The clock signal is made up of square pulses 30. The major time base T is defined between successive rising edges 32. T is shown in FIG. 3A to be shorter than the time interval L (FIG. 3B) that is to be measured by the system. However, it is to be noted that the system described herein will also work for T greater than L. The major time base T will be scaled down to a fine time base $T_s$ by an interpolation process near each boundary of the time interval being measured. It is determined that a major time base of T=20 ns is adequate in providing a 100 ps resolution ($T_s$=100 ps) by scaling T down by a factor of 200 using appropriate hardware in the interpolation process. The system clock used may be a precision crystal controlled oscillator having a precise frequency of 50 MHz which will provide the 20 ns time base.

The system measures time intervals defined in an external input signal. In the particular example shown in FIG. 3B, the input signal consists of a square pulse 34. The time interval to be measured is L, the pulse width defined between the rising edge 36 and the falling edge 38. It is noted that in general, the beginning of a time interval to be measured may be defined by either a rising or falling edge of an input pulse and the end of the interval may be defined by either a rising or falling edge of another input pulse. Typically, the clock is allow to run for some period of time before the input pulse is sampled so that the clock oscillator is in a stabilized state when the input pulse 34 is sampled. Therefore, the input pulse 34 is typically asynchronous to the system clock pulses 30.

Figure 3:
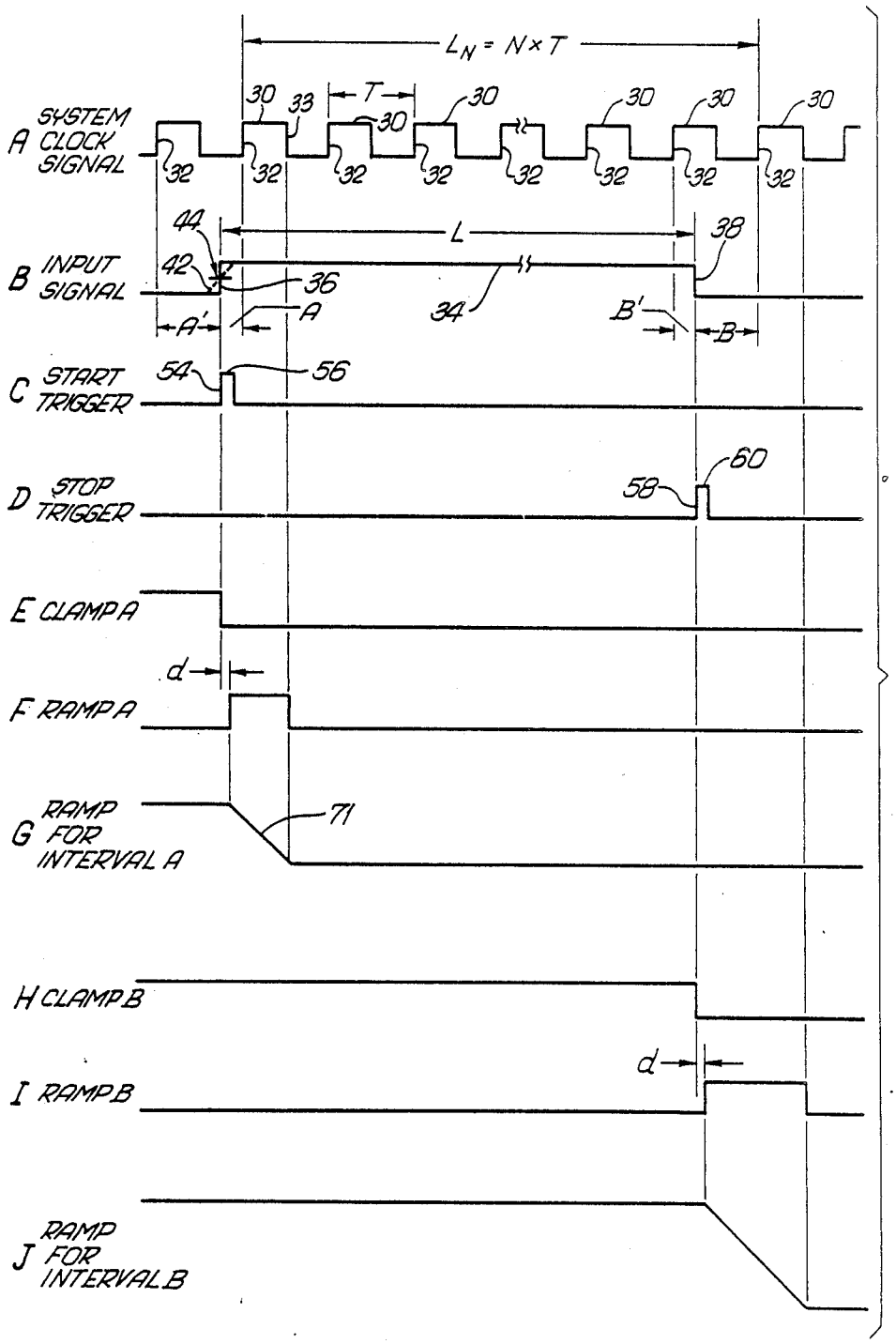
FIG. 3 is a timing diagram illustrating time interval measurement according to the present invention.
Figure 4:
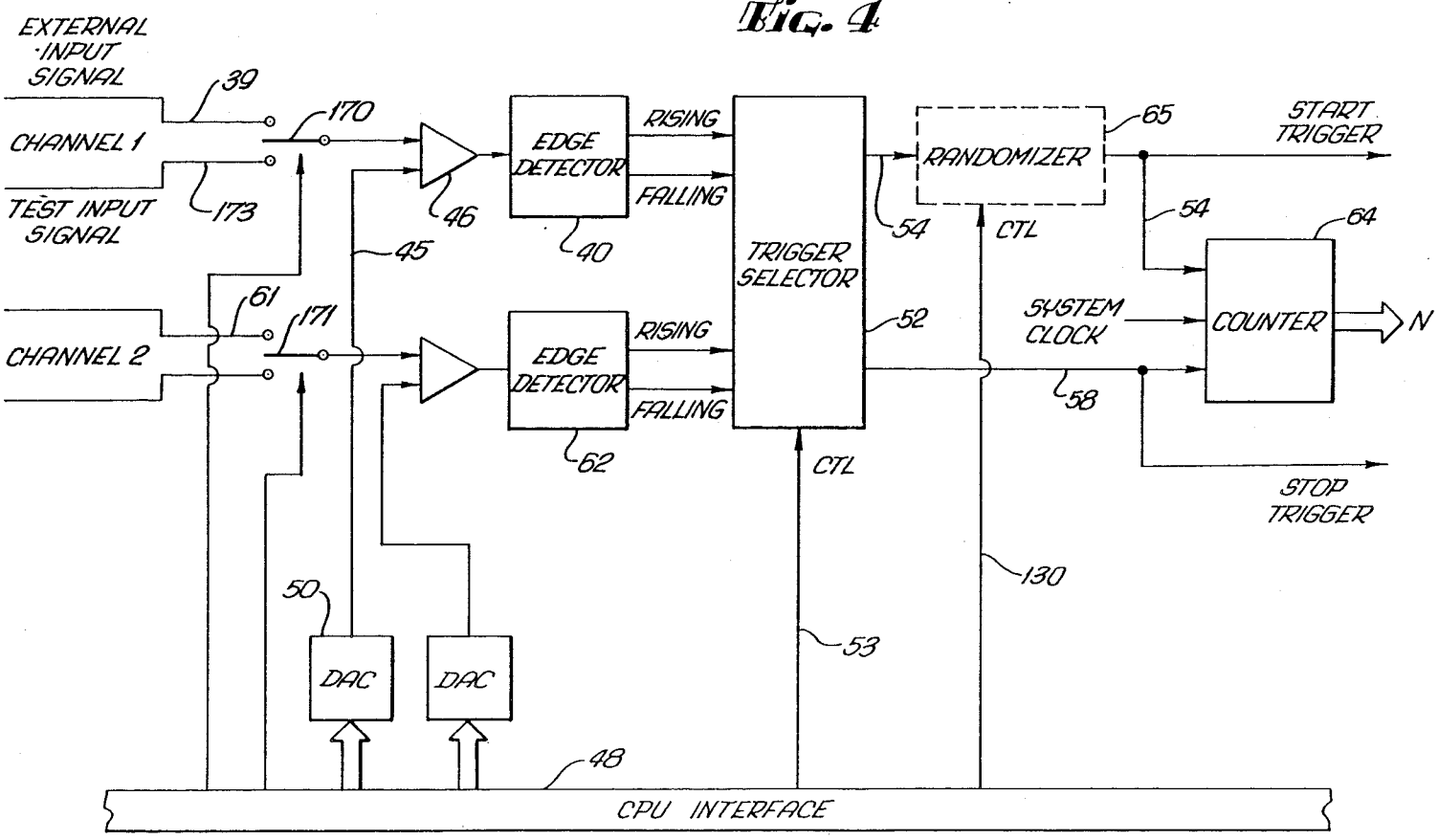
FIG. 4 is a block diagram of the circuit for triggering the interpolation function of the present invention.

In order to detect the boundaries of the time interval L, the rising and falling edges 36 and 38 of the input pulse 34 must be determined. As shown in FIG. 4, the external input signal 39 is input to channel 1 of the system and is directed to an edge detector 40 which detects transitions of the input pulse 34 and determines whether the transitions are rising or falling edges of the pulses. Since in reality, the edges of the input pulse 34 are not vertical (illustrated by dotted line 42 in FIG. 3B), the transition of an edge is considered to occur at the instance when the edge crosses a certain threshold reference 44. A comparator 46 is used to compare the input signal to the threshold reference 44 to determine the instance of the transition. The threshold reference 44 may be controlled, for example, by a central processing unit ("CPU", not shown) in the system via a CPU interface 48 and a digital-to-analog converter ("DAC") 50 which provides an analog reference signal 45 to the comparator 46.

After a transition edge has been detected and its type determined by the edge detector 40, a trigger selector 52 selectively produces either a start or stop trigger, depending on its programmed triggering response to the detected transitions, to mark the beginning or end of the time interval L. Specifically, the trigger selector may be controlled by control signal 53 from the CPU to produce a start trigger 56 at the instance a rising edge is detected by the edge detector 40, and to produce a stop trigger 50 when a falling edge is detected. This situation is illustrated in FIGS. 3C and D, respectively. The rising edge 54 of the start trigger 56 coincides with the rising edge 36 of the input pulse 34, and the rising edge 58 of the stop trigger 60 coincides with the falling edge 38 of the input pulse 34. Thus, the start and stop triggers 56 and 60 mark the beginning and end of the time interval L. It is noted that whenever stop and start triggers are referred to hereinafter, it is the rising edges of the respective triggers that are being referred.

Trigger selection is described above with reference to one input channel (channel 1). To accommodate the situation in which time intervals are measured between pulses of two input signals, an additional input channel (channel 2) is provided in the present system. A second input signal 61 is input to channel 2. The second input signal is processed by an edge detector 62 in the same manner as the input signal in channel 1. The types of transition edges detected of the pulses in the second input signal is applied to the trigger selector 52. In this dual channel arrangement, the trigger selector 52 may be programmed to produce a start trigger at either a rising or falling edge of one of the input signals and to produce a stop trigger at either a rising or falling edge of a pulse in the other input signal, thus marking the start and end of the time interval to be measured between two pulse edges in the two input signals.

The start trigger 56 from the trigger selector 52 is used to activate a counter 64. (The randomizer 65 shown in FIG. 4 is an option which will be described later with reference to time interval measurements of a large sample.) The state of the counter 64 was previously reset to zero before the start trigger. The system clock signal is input to the counter 64 whereby after the start trigger 56 is received by the counter 64, the clock pulses 30 increment the counter 64 at the beginning of each major time base as defined by the rising edge 32 of each clock pulse. The counter 64 is stopped at the instant of the stop trigger 60. Since the start and stop triggers 56 and 60 correspond to the boundaries of the time interval L being measured, the result of the counter 64 represents N, an integral number of discrete clock pulses whose rising edges occur within the time interval L. Preferably, the output of the counter 64 is in digital format such as a binary number. Given time base T, N clock pulses correspond to the interval time $L_N = N \times T$.

The start trigger 56 and the stop trigger 60 are also employed to trigger the interpolation function of the present system. The interpolation function scales down the major time base T of the system clock into a finer time base $T_s$ for measuring the intervals A and B from the respective boundaries 36 and 38 of the time interval L to the rising edges 32 of the respective clock pulses immediately following the respective interval boundaries. Each of said intervals A or B is less than one major time base T. Intervals A and B are each represented by the product of $N_s$, the number of finer time base periods $T_s$ making up each interval, and $T_s$. The time interval L is given by the expression $L = L_N + A - B$ where $L_N$ is a function of N and A and B are functions of $N_s$.

The interpolation function makes use of an interpolator in connection with each of intervals A and B (interpolators A and B, respectively). As previously stated, typically, the input signal is asynchronous to the clock pulses as the clock is not triggered to start at the beginning of the input pulse 24, i.e., A is not equal to 0. The present system is therefore described hereinafter with reference to an asynchronous clock signal and two interpolators. However, it is to be understood that in a system in which the clock is triggered to start exactly at the start of the input pulse 34, i.e., A=0, then one interpolator is required for interval B only.

The interpolator A will be described with reference to FIG. 5. The interpolator A generally includes a ramp generator 66 which is capable of generating a signal (referred to as a "ramp") having an amplitude that varies linearly with respect to time, and an analog-to-digital converter ("ADC") 68 for measuring the amplitude of the ramp at a desired instant. A ramp timing control 69 is also provided for controlling the operation of the ramp generator 66. The inputs to the timing control 69 are the start and stop triggers from the trigger selector 52 and the system clock signal.

In the preferred embodiment, the ramp generator 66 is of the type which produces a linearly decreasing voltage signal (ramp 71 as shown in FIG. 3G) wherein the slope of the ramp 71 is selectable as desired. The ramp generator 66 generally includes a capacitor 70 whose potential difference is the output 72 of the ramp generator 66. The capacitor 70 is connected to a reference voltage source 73, shown here as +3 V, through a switch 74 (often referred to as a "clamp" in connection with a ramp generator) which is controlled by a signal 76 referred to as "CLAMP A" from the ramp timing control 69.

Before the start of the ramp 71, CLAMP A is applied to close the switch 74. The capacitor 70 stores electric charges from the source 73 during the time CLAMP A is applied and the potential difference across the capacitor is maintained or clamped at the reference voltage +3 V. A switch 76 between the capacitor 70 and a current sink 78 is left open when the capacitor 70 is being charged. The ramp generator 66 thus maintains an initial voltage level of 3 V before the start of the ramp 71. Typically, the ramp 71 is clamped at the initial voltage when the system re-arms after the data processing time following the completion of a preceding time interval measurement.

The switch 76 is controlled by signal 80 referred to as "RAMP A" from the timing control 69. As shown in FIG. 5, RAMP A is applied to an AND gate 82 whose output is connected to the switch 76. The AND gate 82 is used for disabling the ramp generator of the interpolator A during calibration of the interpolator B as will be described later. During normal measurement operation, the input 161 to the AND gate 82 is maintained at logic 1.

At the start of the ramp 71, its clamp is removed, i.e., the switch 74 is opened by turning oft CLAMP A and the switch 76 is closed by applying RAMP A, thereby allowing the capacitor 70 to discharge its stored charge through a current sink 78. To produce a linearly decreasing voltage ramp, the current sink 78 used in the ramp generator 66 is of the type capable of draining charges at a constant rate throughout the duration of the ramp. As the capacitor 70 discharges at a constant rate, the potential difference across the capacitor 70 decreases linearly. Thus, the voltage level of the ramp decreases linearly. The drain rate of the current sink 78 may be controlled by the CPU via a DAC 83 thereby to obtain a different rate of decrease in the voltage level of the ramp 71, i.e. to change the slope of the ramp 71.

To stop the ramp 71, the signal RAMP A is removed to open the switch 76 to stop further drainage of charge from the capacitor 70 through the current sink 78. The ramp output voltage is thus maintained at a constant level when the ramp stops.

The timing of the ramp generator 66 in connection with the time interval measurement of interval A will be described with reference to FIGS. 3E, F and G. The ramp 71 is started at the instant of the start trigger 56. When the start trigger 56 is received by the ramp timing control 69, it starts the ramp 71 by turning off CLAMP A and turning on RAMP A. Thus, with the switch 74 opened and the switch 76 closed, the capacitor 70 discharges. Typically, RAMP A is turned on after a short interval d following the end of CLAMP A. This is to ensure that the switch 76 does not close before the switch 74 has been opened since there may be delays in the response of the ramp timing control 69 to the start trigger 56 in generating CLAMP A. This delay interval d is compensated for in the calibration routine which will be described later. The ramp voltage will continue to decrease as the capacitor 70 discharges until the instance a predetermined transition edge, e.g. a rising edge or falling edge, of the system clock is encountered by the ramp timing control 69 following the start trigger 56. The ramp timing control stops the ramp by turning off RAMP A at the instant of this predetermined transition edge. The ramp voltage at the stop of the ramp 71 is representative of the interval A.

Since the ramp 71 is used for measuring the interval A which is less than one major time base T, the full scale (maximum) ramp time $t_{max}$ should be at least one time base T. It is noted that there may be transient non-linearities arising from transient noise unavoidably present at the start of the ramp. Therefore, in order to ensure that the ramp is stopped and the ramp output is measured at a linear portion of its slope after the transient non-linearities have decayed, the ramp should activate for a predetermined minimum time before the ramp is stopped. Thus preferably, the full scale ramp time $t_{max}$ is made at least one and a half times the major time base (1.5T) and the predetermined transition edge of the clock for stopping the ramp is chosen to be the first falling edge 33 after the first rising edge 32 of the clock following the start trigger 56.

Figure 6:
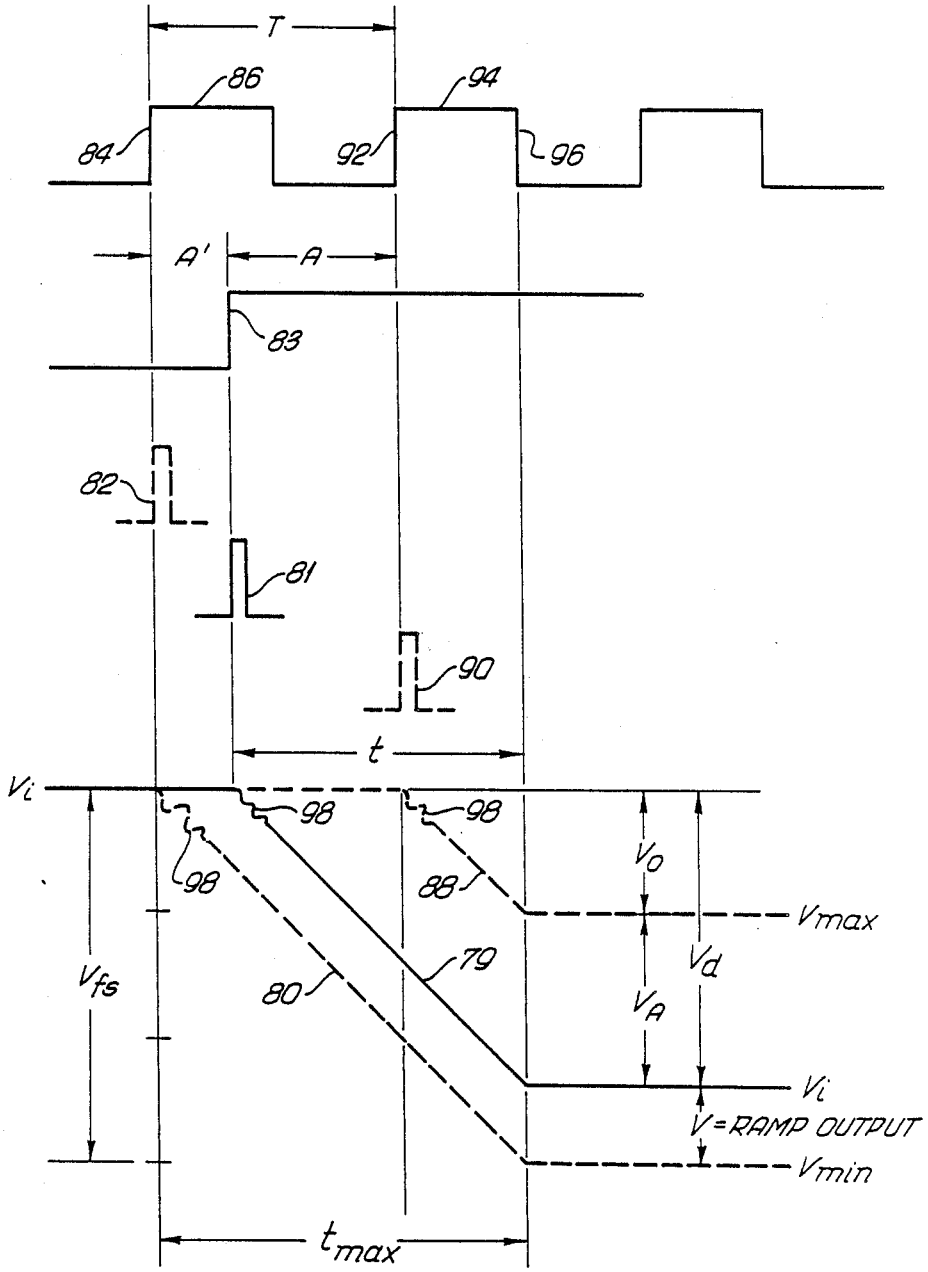
FIG. 6 is a diagram illustrating the relationship between system clock signal, input signal and ramp signal.

Referring to FIG. 6, a ramp 79 is shown which is started by start trigger 81. The ramp time is t and the ramp output at the point at which the ramp is stopped is V. Dotted line 80 is a ramp that would have been started by a start trigger 82 that occurs at the rising edge 80 of the clock pulse 86. Dotted line 88 is a ramp that would have been started by a start trigger that occurs at the rising edge 92 of the clock pulse 94. (Note that the delay d (FIG. 3F) between the start trigger 56 and the actual start of the ramp at RAMP A is omitted in the discussion herein for simplicity. This delay d does not affect the analysis since its effect will be offset after system calibration.) These dotted lines 80 and 88 represent ramps having the maximum and minimum ramp time possible, respectively, with respect to the possible minimum and maximum values, respectively, of interval A. By stopping the ramp at the first falling edge 96 after the first rising edge 92 of the clock signal following the start of the ramp, the ramp is activated for at least one third of the full scale ramp time thereby allowing sufficient time for the ramp to settle to a linear slope before the ramp is stopped for voltage measurement. Any transient non-linearities 98 unavoidably present at the start of the ramp are allowed to decay during this period.

The minimum ramp time $t_o$ corresponds to half a major time base (0.5T) of the clock signal in the particular ramp shown in FIG. 6. The minimum drop in ramp voltage is $V_o=1$ V. It is to be understood that the full scale ramp time may be more than 1.5 T when a ramp having a less steep slope is used. However, it is preferred to use the steepest slope possible to give a highest change in voltage per unit time for better resolution. The full scale ramp time may be adjusted by controlling the drain rate of the current sink 78 thereby changing the slope of the ramp signal.

In the particular ramp shown in FIG. 6, the range of ramp output V that can be measured is from $V_{min}$ to $V_{max}$. It is noted that the minimum ramp output $V_{min}$ corresponds to the longest interval A and the maximum ramp output $V_{max}$ corresponds to the smallest interval A. Since interval A is always less than T, the minimum measurable ramp output $V_{min}$ is actually just greater than zero.

Figure 7:
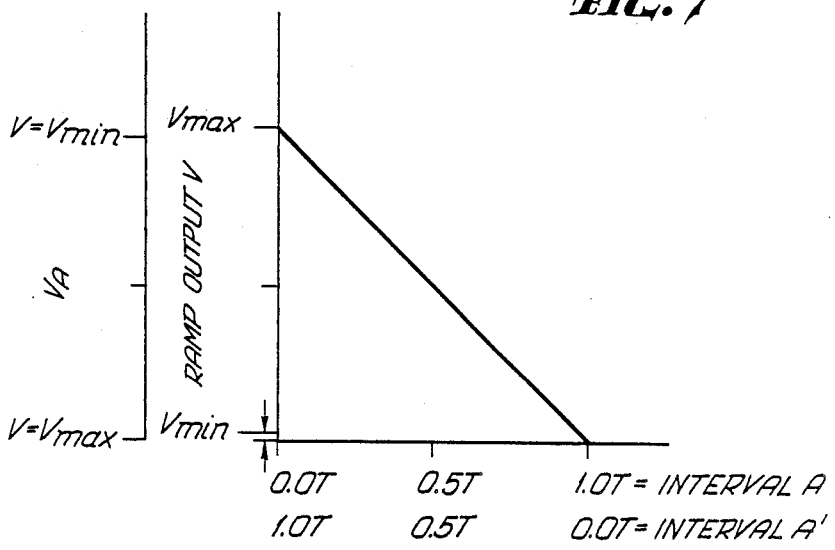
FIG. 7 is a graph of a ramp mapping function representing the correspondence between ramp outputs and values of time interval A.

The measured ramp output V at the stop of the ramp is directly proportional to A' which is (T−A). The drop $V_d$ in the ramp voltage from the initial level $V_i$ (or full scale ramp voltage $V_{fs}$) is linearly dependent on the length of interval A, given that the voltage drop $V_d$ is linearly proportional to the ramp time. More particularly which is the difference between $V_d$ and $V_o$ (the drop in ramp voltage corresponding to the minimum ramp time to) is proportional to the size of interval A. Since $V_o$ is known from a known to (in this case 0.5T) and a given slope of the ramp, and is determined from V and $V_i$ wherein $V_d=V_i-V$, thus $V_A=V_i-V_o-V$, or $V_{max}-V$. The correspondence between V, $V_A$ and intervals A and A' are shown by the graph in FIG. 7 which is the mapping function representing the relationship between the values of interval A and the ramp output V.

Referring back to FIG. 5 the output V of the ramp generator 66 is sampled by ADC 68 at the stop of the ramp. The ADC 68 is preferably of the parallel conversion type well known in the art which is capable of high speed conversion of analog voltage signal into digital signal preferably in binary form. The resolution of the ADC is plus or minus one least significant bit ("LSB") of the binary data. The range of outputs of the ADC 68 should correspond to the full range of possible values of interval A. That is, the ADC 68 outputs should respond to the full range of ramp outputs V corresponding to the range of possible values of interval A.

Figure 8A:
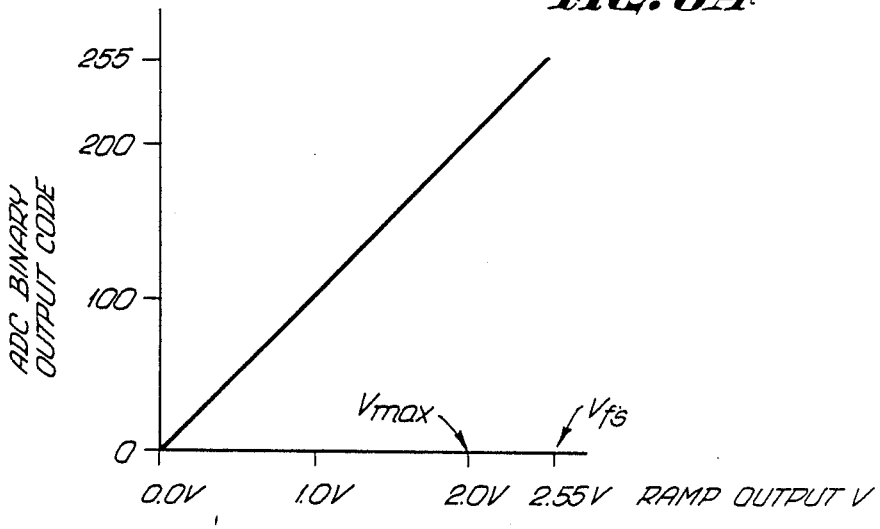
FIG. 8 is a graph of a transfer function of an analog-to-digital converter.

The output of the ADC 68 in response to the analog signal is dependent or the particular transfer function of the ADC 68. The slope of the transfer function of the ADC is adjustable by varying the reference input voltages +REF and −REF to the ADC 68 using a dual 8-bit DAC 97 (FIG. 5). In FIG. 8A, a transfer function is shown illustrating the correspondence between input ramp voltage V and the binary output code.

Referring to the previous discussion in connection with FIG. 6, the output direct from the ADC 68 is the binary conversion of the ramp output V measured at the stop of the ramp instead of the drop in ramp volta $V_A$ during the interval A. The ramp output V measured by the ADC 68 is $V_{max}$ minus $V_A$, which corresponds directly to interval A' which is the interval from the edge 83 to the preceding clock rising edge 84 as shown in FIG. 3. Thus, the maximum ADC output corresponds to a maximum time of interval A'(or zero interval A) which is equivalent to one period T of the major time base used.

Figure 8B:
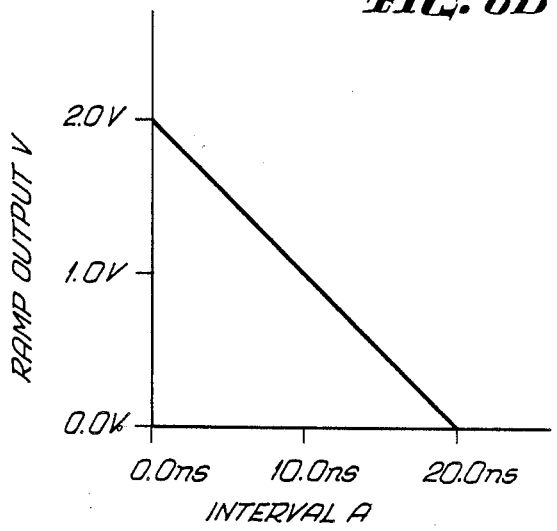

Given that the ramp used has a slope of 1.0 V/10 ns (FIG. 8B), thus $V_{max}=2.0$ V and $V_{min}$ is just greater than zero volts since the measurable A' is never zero because interval A is never 20 ns. The ADC used in FIG. 5 is an 8-bit binary converter which provides 256 possible binary output codes (0 to 255 counts). The transfer function of the ADC is selected to be 1 count/0.01 V. The binary code of 200 corresponds to ramp output V=2.0 V which corresponds to an interval A' of 20.0 ns, or zero interval A. Since interval A' is never zero (as interval A is never 20 ns), the binary code 1 is the least output corresponding to ramp output V=0.01 V which corresponds to an interval A' of 0.1 ns, or interval A of 19.9 ns.

The resolution of the ADC in binary conversion is plus or minus one LSB or one count, representing 100 ps. It follows that the resolution of the interpolation function using the ADC 68 is plus or minus 100 ps. In effect, the major time base T=20 ns has been divided into 200 parts of 100 ps each for interval A measurements.

The resolution of the ADC can be improved by increasing the range of output codes of the ADC in reference to the same range of analog signal. This is done by increasing the slope of the ADC transfer function by changing the +REF and −REF input voltages so that a binary code higher than 200 corresponds to $V_{max}=2.0$ V. However, the transfer function is preferably chosen to be such that less than 255 corresponds to $V_{max}$ for reasons that will become clear when the calibration function is described.

Once the count of the number of fine time base corresponding to interval A' has been determined from the ramp output V, the count of the number of fine time base corresponding to interval A can be determined.

In connection with time measurements of interval B, a similar ramp generator 100 is provided in interpolator B. The ramp generator 100 generates a ramp in response to signal RAMP B and clamp signal CLAMP B from the ramp timing control 69 at the instant of the stop trigger 60 (instead of a start trigger). The ramp is stopped at the first falling edge after the first rising edge following the stop trigger 60 in the same manner as for interval A. The output of the ramp generator 100 is sampled by an ADC 102 similar to the one described above inconnection with interval A to produce a binary code which corresponds directly to B' where B' is the interval from the edge 38 to the preceding clock rising edge (FIG. 3), wherein $B'=T-B$.

The time interval L being measured is the time corresponding to N rising edges of the clock pulses each representing one major time base T counted within the interval L, plus the time corresponding to the count of finer time base $T_s$ during interval A minus the time corresponding to the count of $T_s$ during interval B. Thus, the results of the counter 64 and the ADC's 68 and 102 together provide the time interval L. Specifically, $L=L_N+A-B=(N\times T)+(T_s\times N_s)_A-(T_s\times N_s)_B$, where $T_s$ and $N_s$ are the fine time base and the count of the number of fine time base, respectively, for the respective intervals A and B. It is noted that the binary counts of the counter 64 and of the ADC's 68 and 102 are of different bases. Specifically, in the example described, each count of the counter 64 represents T=20 ns and each count of the ADCs represents 1/200 of 20 ns or $T_s$=100 ps. The components of L may be combined and stored in a memory or converted into a number on a time scale indicative of the measured interval time.

From the foregoing description, it can be seen that the present system precisely measures time interval L by providing a major time base T using a system clock and a fine time base $T_s$ by subdividing the major time base, such as by a factor of 200 using an interpolation process, to account for the portions A and B of the time interval L which correspond to partial clock pulses near its boundaries. The resolution of the system corresponds to the fine time base $T_s$ and is determined by the resolution of the analog-to-digital converters used in the interpolation process.

The time interval measurement technique may be applied for analyzing a large sample of time intervals defined in an input signal. For example, in the situation where the input signal comprises a stream of data pulses of different widths, it may be desirable to analyze the signal to determine the widths of the pulses and the number of pulses having the same width for each different width. Typically, it is useful to represent the result of such multiple time interval measurements as a probability density function, or histogram, whereby the number of occurrences of each of the different interval time, representative of pulse width, detected in the input signal are plotted versus the corresponding interval time.

Figure 9:
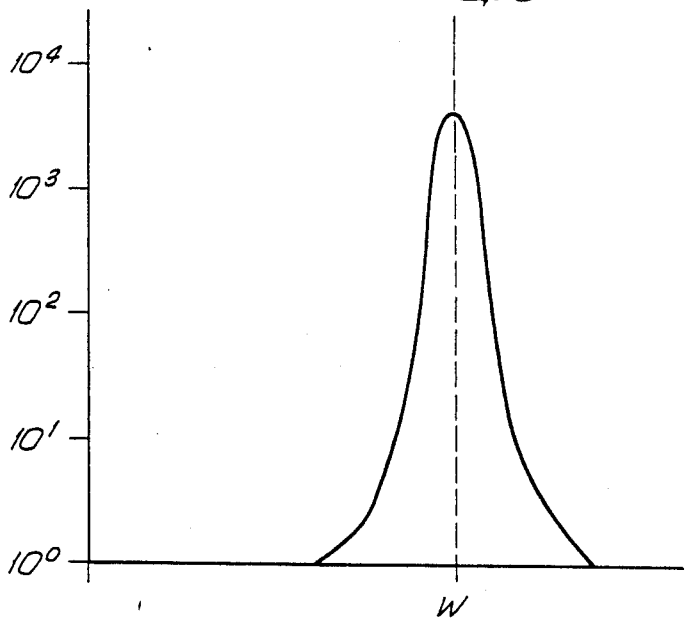
FIG. 9 is a histogram representing a distribution of the occurrences of different values of time intervals in a large sample.
Figure 17:
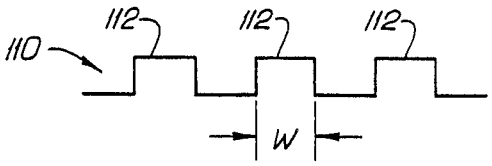
FIG. 17 shows a waveform comprising large number of pulses of nominal width W.

FIG. 9 shows an example of a histogram representing the result of a large sample of time interval measurements of a signal 110 (shown in FIG. 17) which comprises pulses 112 of a nominal width W. Due to perturbation of the signal, the sizes of some of the pulses 112 may differ slightly from their nominal width W. Thus the time interval measurements of the pulse widths will indicate that there are some time intervals which are slightly different from the nominal time interval W which corresponds to the nominal width of the pulses. The histogram 114 provides an indication of the extent of variance in the measured pulse widths and the number of the occurrences of each width that is different from the nominal. For the purpose of time interval analysis of a large sample, it is more appropriate to represent the histogram on a logarithmic scale.

Referring back to FIG. 4, a randomization function may be provided in the present system for facilitating time interval measurements of a large sample. A randomizer 65 is provided to enable the system to sample the next time interval after a random number of time intervals following the preceding sample in the measurement sequence. That is, the randomizer 65 randomly selects whether to pass a start trigger from the trigger selector 52 onward to the ramp generator 66 and the counter 64.

Figure 10:
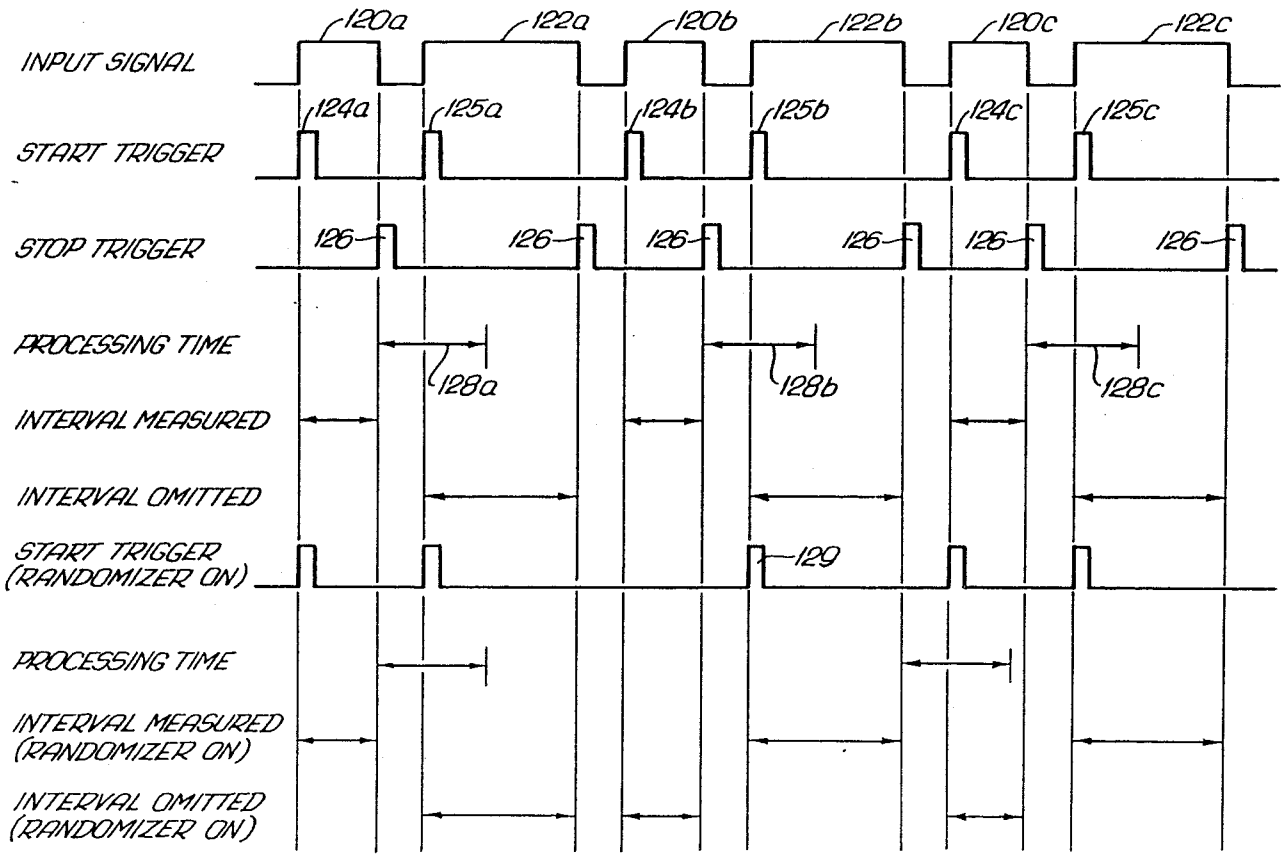
FIG. 10 is a timing diagram illustrating the randomizing function, in connection with multiple time interval measurements.

The function of the randomizer 65 will be described with reference to an input signal having pulses of alternating pulse widths as shown in FIG. 10. If the objective were to measure the pulse widths of the short pulses 120 and the long pulses 122, i.e., the time intervals between the rising and falling edges of the pulses, for a large number of pulses, a start trigger 124 or 125 and a stop trigger 126 should be generated by the trigger selector 52 at the rising edge and the falling edge. respectively, of each pulse. Upon the detection of a stop trigger 126 indicating the end of an interval, the system processes the information representative of this measured time interval. The system processing time 128 has a finite length. At the end of this processing time 128, the system re-arms itself to be ready to sample another time interval by waiting for a start trigger 124 which would define the beginning of that time interval. Without the randomizing function, the system will look for the next start trigger immediately following the preceding processing. For example, at the end of the processing time **128*a* of the time interval measurement of pulse 120*a*, the system will detect start trigger 124*b***.

However, at the end of the preceding processing time **128*a*, the system fails to detect the start trigger 125*a* representative of the start of the long interval 122*a* if the interval between the long interval 122*a* and the short interval 120*a* is shorter than the processing time 128 *a*. The next start trigger 124*b* encountered by the system defines the beginning of the next short interval 120*b*. Similarly, at the end of the processing time for the short interval 120*b*, the system will again fail to detect the start trigger which indicates the beginning of the next long interval 125*b*. The system would therefore systematically fail to sample all the long intervals 120**.

The randomizing function enables the system to respond to a start trigger following a random number of start triggers encountered after the system is re-armed following the preceding measurement. The randomizer 65 randomly bypasses some of the start triggers produced by the trigger selector 52. The desired degree of randomizing, i.e. the maximum random number of start triggers to bypass, may be selected by the user and controlled by the CPU through control signal 130. The random passage of start trigger from the trigger selector 52 through the randomizer 65 may be provided by coupling random noise to a latch circuit including, for example J-K flip flops to randomly gate start triggers generated by the trigger selector 52. The randomizer 65 may incorporate a "white noise" generator that is well known in the art as a source of random noise. The white noise generator generates random noise with equal probability over a range of frequency, for example by amplifying low-level white noise obtained from a source such as a photomultiplier. Alternatively, the randomizer may make use of inherent internal noise of the system arising from sources such as the LSB of a binary signal which will provide a degree of randomizing of 2 as the LSB fluctuates from 1 to 0 and vice versa due to uncertainty associated with the LSB.

For the particular input signal shown in FIG. 10, the randomizer 65 may be selected to randomly trigger on the next available start trigger 124b or second to next available start trigger 125b after the end of the processing time 128a of the first short interval 120a. For example, if the start trigger 129 from the randomizer 66 happens to trigger at the start of the long interval 122b instead of the short interval 120b, the long interval 122b would be sampled. Without the randomizing option, all of the long intervals 122 in the input signal shown in FIG. 10 would not be sampled.

Although with the randomizing option, the system still may not be able to sample every interval defined in the input signal due to finite processing time and close spacing between intervals, the randomizing function is useful in allowing at least the probability of sampling some of the time intervals which otherwise would have been systematically omitted. In a large sample of time intervals such as the example in FIG. 10, the randomizing function allows an even probability of sampling both types of intervals.

In connection with the above described analysis of large samples of time intervals, for each time interval measurement, the binary number N from the counter 64 representing the direct count of the major base T of the system clock and the binary numbers $N_s$ from the ADC's 68 and 102 representative of intervals A' and B' are combined into a single binary number suitable for addressing a specific memory location among a set of memory locations in a high speed random access memory ("RAM"). Each memory location corresponds to a different interval time and the content of each location is representative of the number of occurrences of measured interval time of a particular size. After each time interval measurement, the content of the memory location corresponding to the interval time just measured is addressed using the combined binary number and is incremented by one. The result is stored back into the same location. At the completion of the time interval measurements, the memory locations may be addressed by the CPU of the system to retrieve the data for plotting a histogram for example on a video display.

Figure 11:
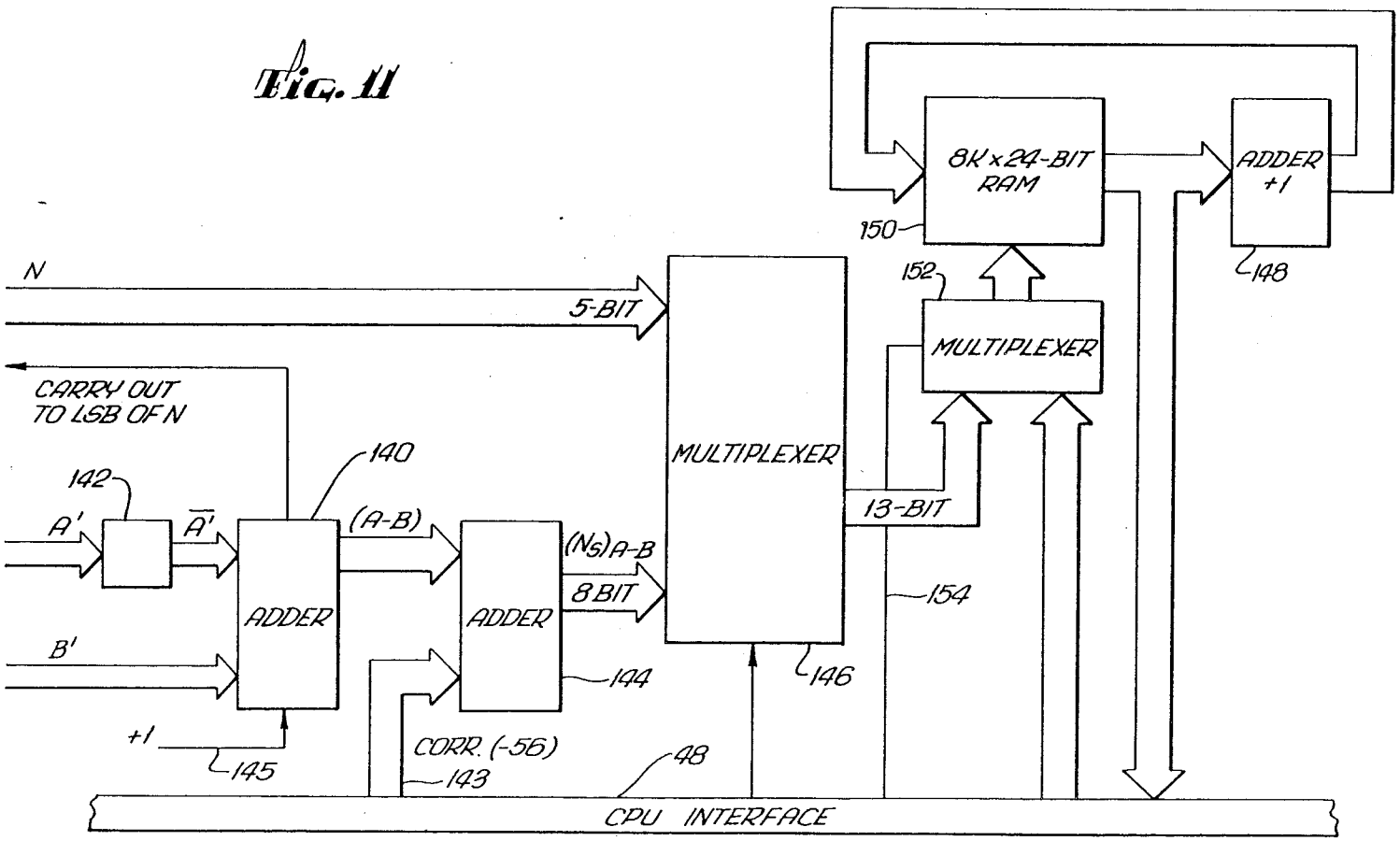
FIG. 11 is a block diagram of the circuit for processing binary data representative of measured interval time.

FIG. 11 illustrates the hardware components which may be implemented for processing the binary data for addressing a RAM location. The ADC output codes corresponding to intervals A' and B' are processed to produce (A−B). An 8-bit adder 140 is provided to produce (A−B) in binary form using binary codes of A' and B' and using the theory of twos complement binary arithmetic operation. Under this theory, (X−Y) is given by $X+\overline{Y}+1$ where X and Y are expressed in binary and where Y is the complement binary of Y, i.e. each bit in Y is inverted from 1 to 0 or vice versa to give $\overline{Y}$. For example, for an 8-bit binary number, if Y=10010100, then $\overline{Y}$=01101011.

A' and B' are applied to arrive at (A−B) in an expression derived as follows (where all terms are expressed in binary codes):

$$\text{Since } A = T - A' \text{ and } B = T - B',$$
$$\text{then } A = T + \overline{A'} + 1 \text{ and } B = T + \overline{B'} + 1.$$

-continued $$\begin{aligned}\text{Therefore } (A - B) &= (T + \overline{A'} + 1) - (T + \overline{B'} + 1)\\ &= \overline{A'} - \overline{B'}\\ &= \overline{A'} + B' + 1\end{aligned}$$

Hence, (A−B) can be obtained without having to convert A' and B' to A and B, respectively.

Referring to FIG. 11, an inverter 142 is provided to invert each bit of A' output from ADC 68 to get $\overline{A'}$. B' is available directly from the ADC 102. The adder 140 simply adds $\overline{A'}$ and B' and a 1-bit carried into the adder from a reference source 145 to arrive at $\overline{A'}+B+1$ to give (A−B). The processing time required to obtain (A−B) from the ADC outputs are kept to a minimum by making minimum number of operations on the ADC outputs A' and B' in their existing form.

Figure 12:
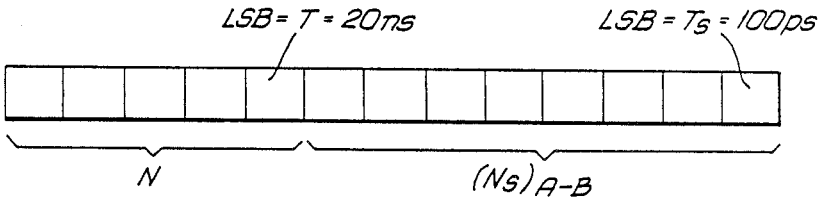
FIG. 12 is a diagram illustrating the structure of a binary number for addressing a memory location in the present system.

A multiplexer 146 conjoins the results from the adder 140 and the counter 64 into a single number such as a 13 bit number for addressing a high speed 8K×24-bit RAM 150. Referring to FIG. 12, for a major time base of T=20 ns and a fine time base of $T_s$=100 ps, this 13-bit number is the result of conjoining an 8-bit binary number which is the count of time base $(N_s)A-B$ representative of (A−B) and a 5-bit binary number which is the count N of the major time base T representative of $L_N$, the total interval of N clock pulses. The numbers N and $(N_s)_{A-B}$ are conjoined because the LSB's of these two binary numbers are dissimilar since the LSB of N represents T=20 ns and the LSB of $(N_s)_{A-B}$ represents $T_s$=100 ps. The 8 bits of $(N_s)_{A-B}$ represent the 256 possible states (binary codes 0–255) of time interval (A−B). Nominally, only a maximum of 200 of the 256 possible states for (A−B) are generated (binary codes corresponding to 0–19.9 ns) because (A−B) is less than 20 ns which corresponds to binary code 200, or to the 201st state. For (A−B) of 20 ns or more, N would have been incremented by 1 by the system clock and the resultant A−B would be less than 20 ns.

The 5-bit number occupies the five highest order position of the 13-bit number. The 9th bit of this 13-bit number is the LSB of N, representative of 200 counts of the 100 ps time intervals or 20 ns. In the situation where B is greater than A, (A−B) will be negative and a 1-bit which represents that a binary number is negative is carried out from the most significant bit ("MSB") of the 8-bit adder 140. This bit is used to decrement the direct count N of the counter 64 by 1. Thus the LSB of N and thus the 9th bit of the 13-bit number is reduced by 1. This operation is equivalent to a "borrow" in the subtraction of a digit from a larger digit of the same base in decimal system. Decreasing N by 1, a major time base T is in effect borrowed to combine with the negative (A−B) to result in a positive number. Since in a binary system, the 9th bit represents 256 counts, a correction offset 143 is made to this number to reduce the 256 counts in the 9th bit borrowed to 200 counts which represents T. An adder 144 is used to combine (A−B) and the correction offset 143 which is the twos complement of binary code 56.

Figure 13:
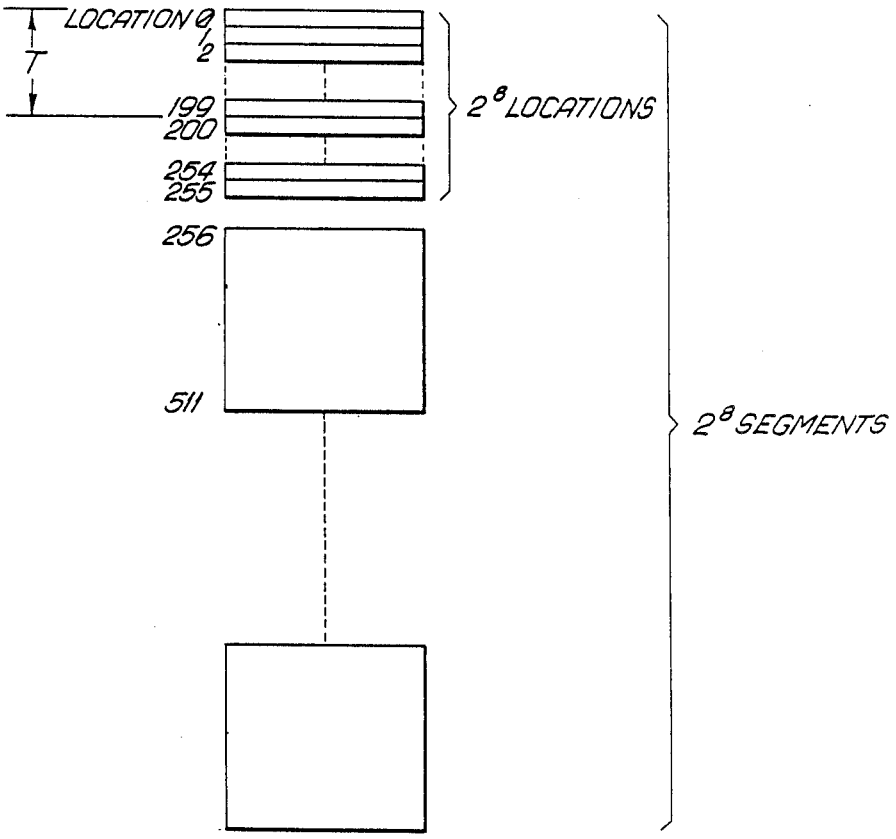
FIG. 13 is a diagram illustrating the structure of random access memory which may be addressed by the number in FIG. 12.

Referring to FIG. 13, the 13 bit number from the multiplexer 146 may be used to address a total of $2^{13}$ memory locations consisting of $2^5$ segments each comprising $2^8$ consecutive memory locations. Each segment corresponds to one increment of T and each location in a segment corresponds to one increment of $T_s$. Thus, the maximum value of interval L that can be measured is approximately $2^5$ T. There exists a gap equal to 56 memory locations within each memory segment (location 200–255, 456–511, etc.) which is not used since only 200 locations are used in each segment corresponding to an (A−B) of less than 1 major time base T. The 56 unused locations are appended at the end of the first 200 memory locations in each segment.

Each time the RAM 150 is addressed by a conjoint 13-bit number from the multiplexer 146, the content of the memory location addressed is read out, and is incremented by 1 using an adder 148. The result is stored back into the same location. At the end of the measurement sequence, the contents of the RAM 150 may be read out to be used to form a histogram by addressing the memory locations of the RAM 150 under CPU control. A multiplexer 152 controlled by signal 154 from the CPU is used to selectively direct address signals from either the CPU or the multiplexer 146.

The 13-bit binary number from the multiplexer 144 has been described with reference to conjoining a 5-bit and an 8-bit number. This is applicable to a resolution of $T_s$=100 ps. For a different resolution such as $T_s$=200 ps, there will be 100 possible states for (A−B) within 20 ns thus requiring only a 7-bit output from the ADC's. Hence, the size of the binary, number representing N from the counter 64 can be increased to a 6-bit number to make up a total of 13 bits with the 7-bit ADC output. In this situation, the maximum value of interval L that can be measured can be increased from roughly $2^5$T to $2^6$T.

Due to the fact that the interpolators A and B typically are made up of circuit components whose functional characteristics are sensitive to the operating condition of the system, such as operating temperature, the slope of the ramp signal and the transfer function of the ADC of each interpolator may change with a change in operating temperature, thereby affecting the results of time interval measurement. The present time interval measurement system provides a scheme for calibrating the interpolators independent o each other. Certain adjustments are made to the components of each interpolator circuitry. The adjustments may be performed manually or preferably under CPU control in an automatic system self calibration mode.

Basically, the slopes of the ramps produced by the respective ramp generators 66 and 100 and the transfer functions of the respective ADC's 68 and 102 are adjusted so that the range of ramp outputs corresponds to the range of possible values of interval A and that the range of ADC outputs corresponds to such range of ramp outputs. A sequential adjustment procedure is utilized whereby each ramp generator is adjusted independently of the other to set the desired output range by changing the slope of the ramp signal. Following each ramp generator adjustment, the respective ADC is also adjusted accordingly to set the desired output transfer function. The adjustment of each component is performed in iterative steps until the desired result is obtained.

To setup the system for calibration, the CPU disconnects the external inputs to channels 1 and 2 by means of switches 170 and 171 (FIG. 4). Switch 170 replaces the external input to channel 1 with a test input signal 173 comprising square pulses of a known precise frequency. The test signal may be provided by a precision crystal oscillator (not shown) which is built into the system.

The adjustments of the ramp generators and the ADC's will be described with reference to the interpolator A. Such description is also applicable to the interpolator B. In order to calibrate the interpolator A independent of interpolator B, the CPU disables the ramp generator 100 (FIG. 5) thereby disabling the interpolator B. This is done by sending a null signal 160 from the CPU to an AND gate in the ramp generator 100 to disable the effect of the RAMP B signal on the switch between the capacitor and the current sink of the ramp generator. These elements are not shown but they are similar in structure and function to those shown in the ramp generator 66. The ramp generator 100 therefore does not generate a ramp signal for measurement of interval B during the calibration process of interpolator A. The counter 64 is also disabled by the CPU so that increments of the clock pulse are not counted during the calibration of interpolator A. Thus, with the counter 64 and the interpolator B disabled, all measurements initiated by the triggering of channel 1 with the test signal will consist solely of interval A since the values of N and interval B are zero.

Figure 14:
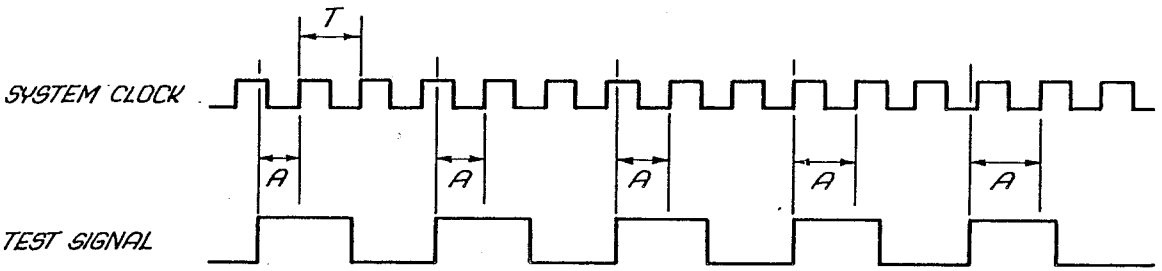
FIG. 14 is a waveform diagram illustrating the asynchronism between system clock signal and test signal.

As shown in FIG. 14 the test signal 173 utilized is a periodic signal and is asynchronous to the system clock signal. The test signal 173 shown is at a lower frequency than the system clock signal. The pulses of the test signal are therefore larger than the system clock pulses. However, it is to be noted the calibration function described herein can also be carried out using a test signal with pulses smaller than the system clock pulses. Since the test signal and the system clock signal are asynchronous, the respective interval A for each pulse of the test signal will vary from one pulse to the next. In one particular embodiment, the frequency of the test signal is conveniently chosen to be 4.096 MHz with a period of exactly 24.140625 ns. Given a major time base T=20 ns, the interval A will change by 4.140625 ns every test signal period. If a large number of intervals A is sampled for a large number of test signal periods, the values of interval A will vary uniformly from 0 ns to just less than 20 ns (interval A being always less than T=20 ns).

Since interval A is always less than 20 ns, the binary codes representative of interval A should range from 0 to 199 nominally if the ADC 68 and ramp generator 66 have been properly calibrated. Therefore, only locations 0 to 199 of the RAM 150 should contain data once the interpolator A has been calibrated. Given a fine time base of $T_s$=100 ps resolution, the interpolator A can distinguish 200 different values of interval A (0 to 19.9 ns) at increments of 100 ps. For a sample size of 105 measurements, there will be an average of approximately 500 intervals A having values varying within 100 ps for each of the 200 different distinguishable values of interval A. Locations 0 to 199 in the RAM 150 should therefore each register an average of 500 occurrences for each of the 200 different values of interval A per 105 measurements of interval A. By analyzing the distribution of the different values of interval A of a large sample of measurements, the calibration status of interpolator A may be determined.

Figure 15:
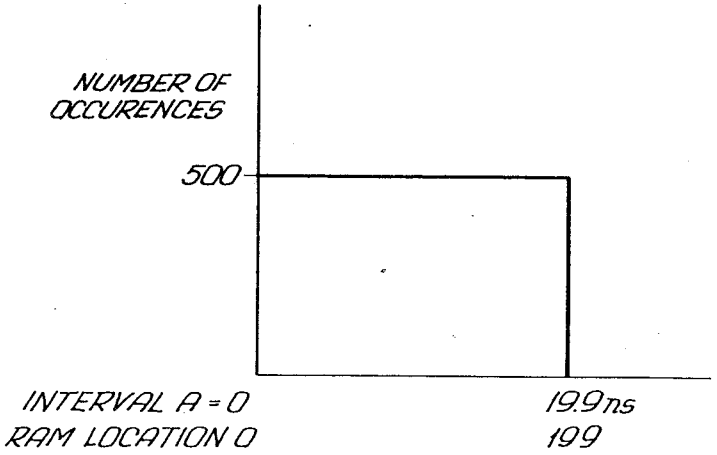
FIG. 15 is a histogram illustrating a nominal uniform distribution of all possible values of interval A in a large sample arising from the asynchronism between system clock signal and test signal.

FIG. 15 shows a histogram representative of a uniform distribution of the different values of interval A as sampled by a calibrated interpolator A for a large sample size of $10^5$ measurements, wherein each value of interval A (0–19.9 ns at 0.1 ns increment corresponding to memory locations 0–199) occurs 500 times. The objective of the adjustments made to interpolator A is therefore to obtain an uniform distribution of all values of interval A in response to the test signal.

FIGS. 16A–E illustrate the sequence of adjustments of the ramp generator 66 and the ADC 68 of the interpolator A. More particularly, the graphs in FIG. 16 illustrate the effect of each step of the adjustment sequence on the transfer function of the ADC 68 and the mapping function of the ramp. More precisely, a transfer function 180 gives the conversion from the measured ramp output voltage to the corresponding binary output code $(N_s)_{A-B}$ from the adder 44 which in this case is representative of A (note that B=0 as interpolator B is disabled when interpolator A is being calibrated) and which is used for addressing the RAM 150. The transfer function 180 is not the conversion from the ramp output to the output of the ADC 68. A mapping function 182 maps time interval A to the ramp output voltage. It is noted that in each graph, dotted lines represent the respective functions before adjustments and solid lines represent the respective functions after adjustments in each step.

In each graph, the transfer function 180 and the mapping function 182 share the same horizontal axis, which represents the ramp output voltage. The two functions have separate vertical axes representing the values of interval A (to the right of the graphs) for the mapping function 182 and the binary output code A (to the left of the graphs) for the transfer function 180. As previously described, $A=T-A'=(20-A')$ ns. Since the measurable value of interval A varies from 0 to 19.9 ns, correspondingly A' varies from 20 to 0.1 ns.

Note that the two vertical axes do not directly correspond to each other. For example, a time interval A of 0 ns does not correspond to binary code 200. Instead, the correspondence between the two vertical axes depends on the particular transfer function and mapping function. For example in FIG. 16A, referring to the nominal transfer function 180*a* and mapping function 182*a*, a time interval A of 15 ns corresponds to a ramp output of V=0.5 V as given by the mapping function 182*a*, and 0.5 V in turn corresponds to binary output 150 as given by the transfer function 180*a*.

Due to a change in operating conditions of the system such as a change in operating temperature which affects the characteristics of the temperature sensitive circuit components of the ramp generator 66 and the ADC 68, the transfer function 180*a* and the mapping function 182*a* may change to different functions, such as illustrated 180*b* and 182*b*, respectively. As a result, the zero and full scale end points of the mapping function 182*b* and the zero and full scale end points of the transfer function 180*b* are out of alignment. The zero and full scale end points of the mapping function are the ramp outputs corresponding to the minimum and maximum values of interval A, respectively, and the zero and full scale end points of the transfer function are the ramp outputs which correspond to binary output codes 0 and 199, respectively, for the particular ADC 68 described.

Figure 16A:
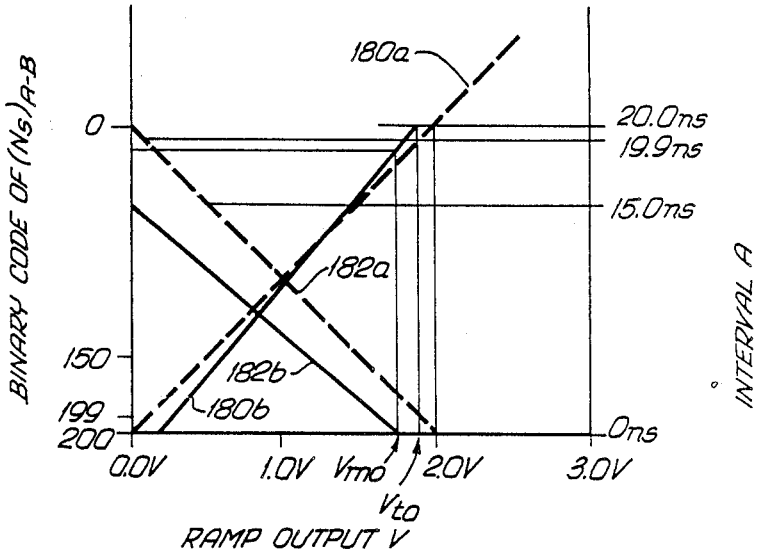
FIGS. 16A–E are graphs illustrating the effect of each step of adjustment made during calibration of the analog-to-digital converter and the ramp.
Figure 16B:
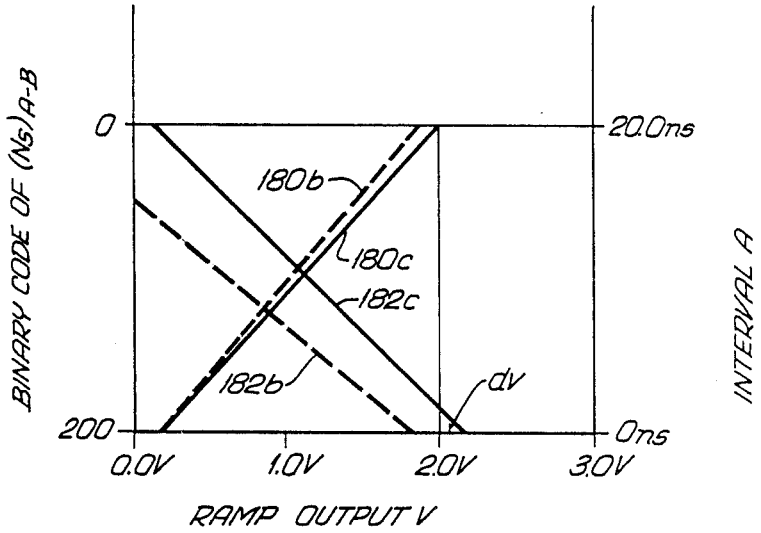
Figure 16C:
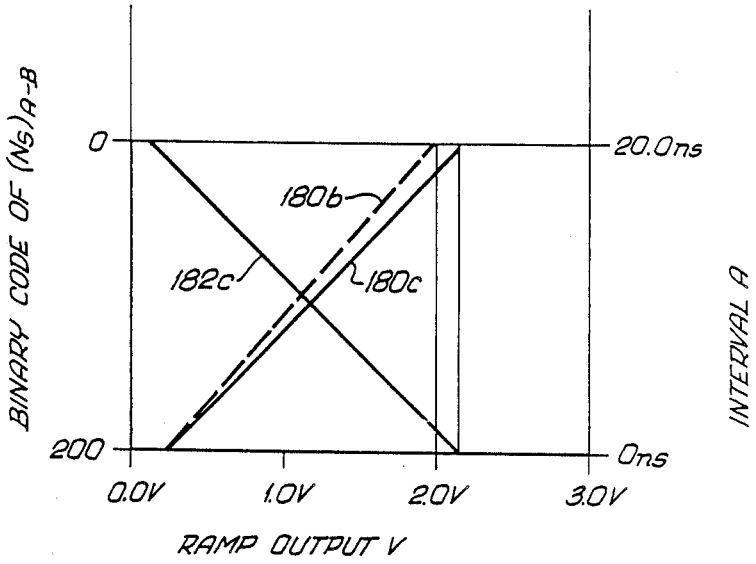

As shown in FIG. 16A, the zero end point of the mapping function 182*a* is shifted from V=2.0 to $V=V_{mo}$. As a result of the shift of the transfer function, the zero end point of the transfer function 180*a* is shifted from V=2.0 to $V=V_{to}$. The shift $V_{mo}$ and $V_{to}$ in zero end points are typically not the same value since the circuit components of the ADC and the ramp generator react differently to a change in operating temperature. Therefore, at $V_{mo}$, which represents the minimum value of interval A, the corresponding output of the ADC is not zero. Accordingly, after sampling a large number of interval A as provided by the asynchronism between the test signal and the system clock signal, location 0 of the RAM 150 will contain a zero value indicating that there is no occurrence of the minimum possible value of interval A despite the fact that the test signal generates the same number of each different values of interval A. Thus it would appear that the minimum value of interval A was not encountered in the test signal.

Thus, it is necessary to match the zero end points of the mapping function and the transfer function to be at same V so that the minimum value of interval A corresponds to binary code 0 whereby location 0 of the RAM 150 may be addressed with this code to increment the content of location 0 by 1 to register the occurrence of interval A=0. It is noted, however, that it is not necessary to match both zero end points at V=2.0 in order to be able to obtain binary code 0. It is only necessary to set the zero end points at the same V. Preferably, the zero end point of the transfer function is initially set at V=2.0 by grounding the −REF input to the ADC. (See transfer function in FIG. 16B.)

Figure 5:
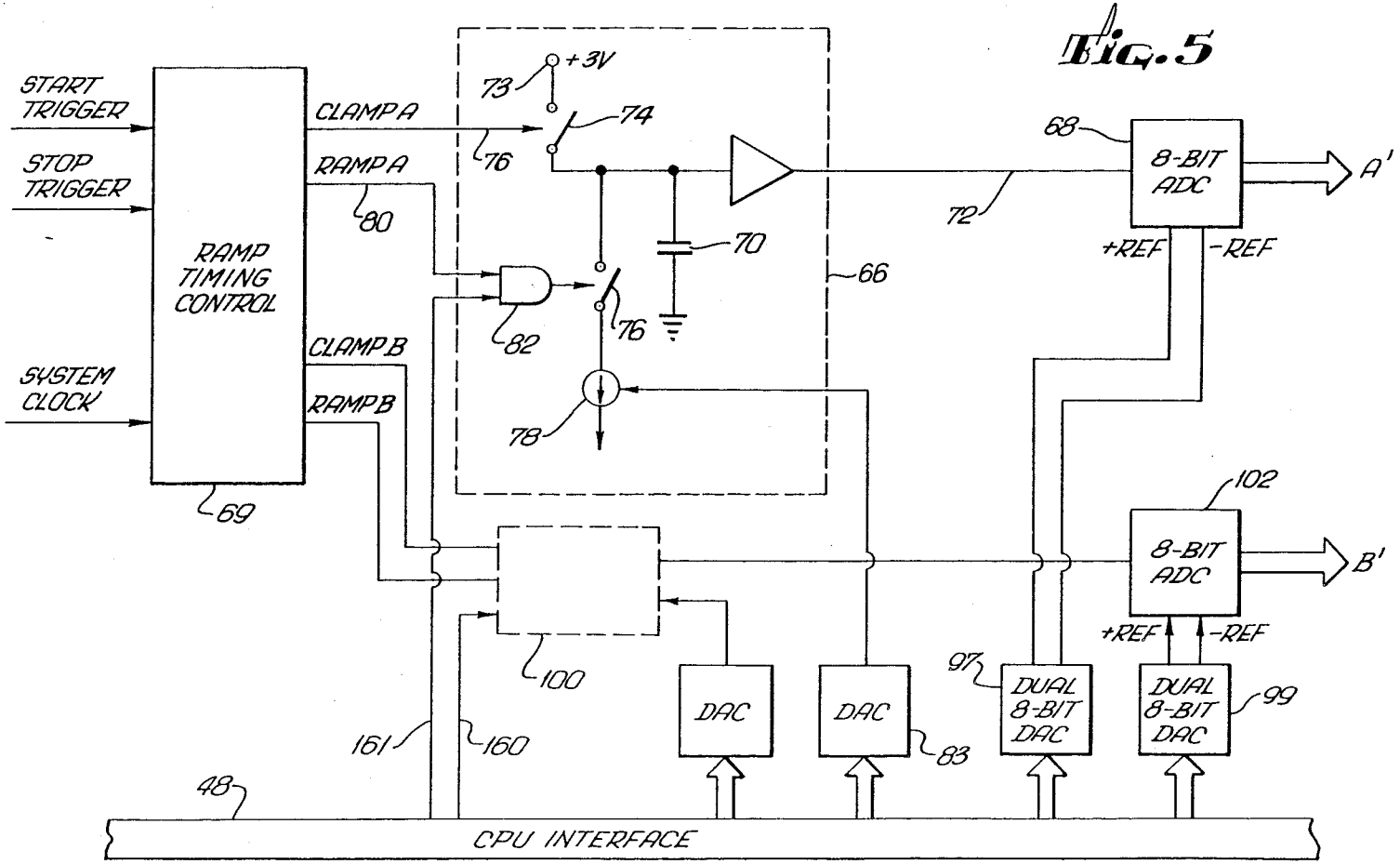
FIG. 5 is a block diagram of the circuit for generating ramp signals and measurement thereof.

The mapping function 182 may be adjusted by adjusting the slope of the ramp, and more particularly, by adjusting the charge drain rate through the current sink 78 of the ramp generator 66 using DAC 83 under CPU control (FIG. 5). In general, when the slope of the ramp is increased or decreased negatively by increasing or decreasing, respectively, the drain rate of the current sink 78, the mapping function 182 shifts to a less or more negative slope, respectively.

The transfer function 180 may be adjusted by adjusting the +REF and −REF input voltages to the ADC 68 such as by using a dual 8-bit DAC 97 under CPU control (FIG. 5). In general, increasing and decreasing the +REF voltage independent of the −REF voltage will decrease and increase, respectively, the slope of the transfer function 180. However, increasing and decreasing the −REF voltage independent of the +REF voltage will increase and decrease, respectively, the slope of the transfer function. When both +REF and −REF are increased or decreased by the same amount, the transfer function 180 shifts upwards or downwards, respectively, to a position parallel to the original transfer function.

In matching the zero end points, the slope of the ramp is adjusted thereby shifting the zero end point of the mapping function 182*b* until the output of adder 144 includes A=0. The zero end point adjustment is performed in iterative steps whereby for each step of such adjustment, a predetermined number of measurements of interval A are taken and the result read out from RAM 150 to determine whether a non-zero count rs observed in location 0 which corresponds to zero ramp output at the minimum value of interval A (0 ns). The ramp adjustment is stopped when the count in location 0 is non-zero. The result of the adjustment is given by mapping function 182*c*. Note that the zero end point of the mapping function 182*c* is not necessarily at exactly 2.0 V because of the coarse resolution in the adjustment of the slope of the ramp using DAC 83 (FIG. 5). The adjustment of the ramp provides only a coarse adjustment of the zero end point to be approximately 2.0 V. The deviation dv from 2.0 V is exaggerated in FIG. 16B.

More precise matching is obtained by changing the −REF input to the ADC. Acting through the DAC 97 (FIG. 5, the CPU adjusts the −REF input to the ADC 68 in iterative steps thereby shifting transfer function 180*c* (FIG. 16*c*) until approximately an expected nominal count is registered in location 0 of the RAM after a large sample of interval A as provided by the asynchronism of the test signal and the system clock. For example, after $10^5$ samples, 500 occurrences of A=0 is expected.

Figure 16D:
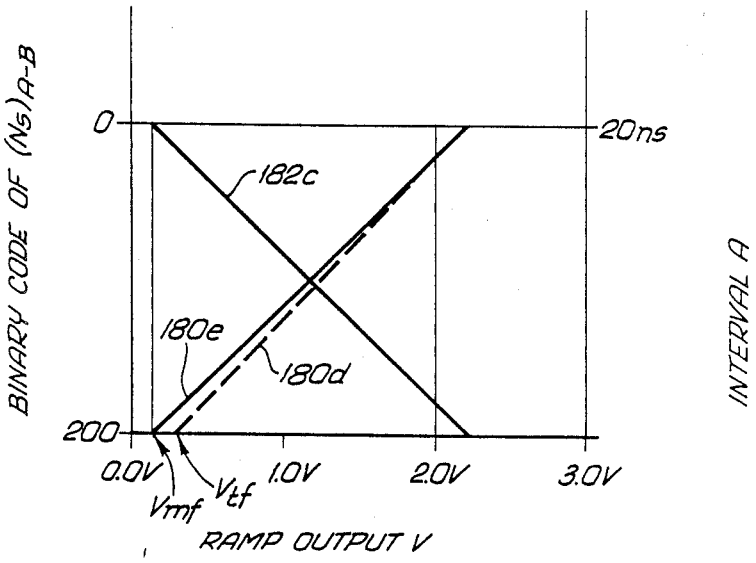
Figure 16E:
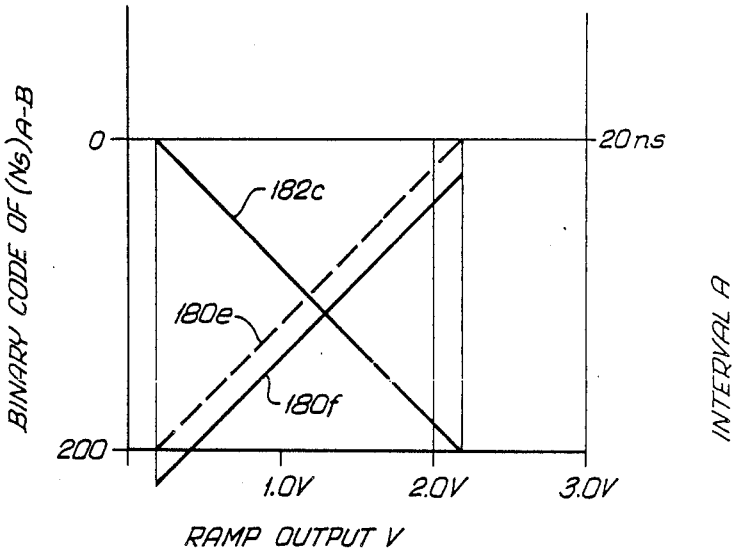

As shown in FIG. 16D, the full scale end point of the transfer function 180d corresponds to the ramp output $V=V_{tf}$ and the full scale end point of the mapping function 182c corresponds to $V=V_{mf}$. Since both full scale end points do not correspond to the same ramp output V at the maximum interval A, for the same reasons previously discussed with reference to zero end point adjustments, there will not be a nominal count of the number of occurrences of maximum interval A registered in location 199 of the RAM 150 after a large sample of interval A.

In a manner similar to the adjustment of the zero end point of the transfer function, the CPU acting through the DAC 97 (FIG. 5) adjusts the +REF input to the ADC in iterative steps thereby shifting the transfer function 180d until a nominal count is registered in location 199 of the RAM 150 after a large sample of interval A.

Once the end points of the mapping function and the ADC transfer function have been matched, i.e., a nominal number of counts of interval A are registered in both locations 0 and 199, presumably locations 1 to 198 will each register the same nominal count assuming that the mapping and transfer function are linear.

After the interpolator A has been adjusted, the interpolator B is adjusted in the same manner as for interpolator A. The interpolator A is disabled while the interpolator B is being adjusted. In particular, the ramp generator 66 (FIG. 5) is disabled using signal 161. The ramp generator 100 is enabled instead. The adjustments of the ramp generator 100 and its associated ADC 102 of the interpolator B are performed in a similar manner as for interpolator A. The end points of the corresponding mapping function are matched to the respective end points of the corresponding transfer function. A nominal distribution of the different values of interval B ranging from 0 ns to 19.9 ns (corresponding to binary output codes 0 to 199) is obtained.

After the interpolators A and B have been adjusted, both ramp generators 66 and 100 and the counter 64 are enabled and the test signal is input to channel 1. The full period of the test signal, i.e., between adjacent rising edges or falling edges of the test signal pulses, is measured in a manner as if an external input signal is being measured. Such measurements should indicate that the average period of the test signal measured is equal to the actual period of the test signal.

If there is any residue error in the measured pulse width after the interpolators A and B have been adjusted independently, it must be the result of differential delays in the processing of the start and stop triggers which respectively triggers the interpolators A and B. This residue error can be eliminated by adjusting interpolator A or B so that the difference between their output (A−B) linearly compensates for this differential delay. Specifically, if the measured period of the test signal is greater than the actual period, the output of B can be artificially increased so that the measured value will be decreased. Likewise, if the measured period of the test signal is less than the actual period, the output of A can be artificially increased to decrease the measured value. The artificial increase in interval A or B in effect offsets systematic errors in the interpolator circuitry.

Interval A or B may be increased by decreasing the −REF and +REF voltages to the respective ADC by the same amount thereby shifting the transfer function 180e downwards to a parallel position 180f (FIG. 16E) while maintaining the match between the corresponding end points. This may be done by coupling the +REF to the −REF such that both reference voltages shift by the same amount when one is shifted. The effect of the adjustments of the reference voltages is to linearly translate or offset (increase) all output codes by the amount of the adjustment. Therefore, a binary output code higher than that before the adjustments is obtained for the same ramp voltage V. Thus the value of A or B is increased to offset for systematic errors. Note that the reference voltages of the ADC's are not increased to obtain the offset since that will effectively translate the transfer function downward such that the binary output code 0 would correspond to a range of input voltages that is greater than the input resolution of the ADC which is 0.01 V.

As a result in the increase in value of either interval A or B, the 56 locations (200–255) in each memory segment that were previously left unused by virtue of the conjoining of N and $(N_s)_{A-B}$ may be addressed. This is because the artificial increase in either the A or B output code may result in (A−B) greater than 199.

Since when (A−B) is equal to or greater than 20 ns, there is in effect an increment of T, the location 199+n in one segment is in effect equivalent to location n in the next segment. Both locations correspond to the same value of interval L. For example, the location 220 (segment 1) in the RAM 150 is in effect equivalent to location 276 (segment 2) in the RAM. Both locations correspond to time interval L of 22 ns.

Accordingly, when the content of the RAM 150 is read out by the CPU, the count in the lower location corresponding to (A−B) greater than 199 is added to the count in the corresponding equivalent higher location. This may be performed using software processing when the data is read out.

Alternatively, with the appropriate hardware, counter 64 may be incremented by 1 before conjoining the count N of the counter 64 with the binary code $(N_s)_{A-B}$ corresponding to (A−B) less 199 for the case when (A−B) is greater than 199. However, it is preferred not to use hardware to correct for (A−B) when it exceeds 199 since it would take longer to process the measurement data before it can be used to address the RAM. A longer processing time will result in longer cycling time of the system for the next measurement following the completion of a preceding time interval measurement. From the discussion in connection with the randomization function, it is more likely that a time interval may be omitted from measurement as a result of long processing time.

In summary, the present invention provides an integrated system for precise measurement of time intervals wherein a high resolution and accuracy can be achieved through the implementation an interpolation function and a self calibration function. The interpolation function scales down a relatively coarse major time base to a finer time base for the portions near the boundaries of the time interval that is being measured. The calibration function is built into the system for facilitating calibration of the interpolation function under actual operating conditions of the system. The calibration function includes sequential independent adjustments of the relevant hardwares under CPU control and overall adjustments to compensate for systematic errors.

While the invention has been described with respect to the preferred embodiments in accordance therewith, it will be apparent to those skilled in the art that various modifications and improvements may be made without departing from the scope and spirit of the invention. Accordingly, it is to be understood that the invention is not to be limited by the specific illustrated embodiments, but only by the scope of the appended claims.

We claim:

1. A system for time interval measurement comprising:

means for receiving an input signal which includes at least one sample time interval that is to be measured;

means for generating a clock signal having a predetermined frequency and clock period;

detecting means for detecting beginning and end of the sample time interval, the beginning and end of the sample time interval forming boundaries of such interval;

a counter providing a digital output;

means responsive to the detecting means for incrementing the counter in response to the clock signal during an interval between the beginning and end of the sample time interval, the output of the counter being representative of an approximation of the value of the sample time interval;

first measuring means for measuring a first time period between the beginning of the sample time interval and the start of the clock period that immediately follows the beginning of the sample time interval;

second measuring means for measuring a second time period between the end of the sample time interval and the start of the clock period that immediately follows the end of the sample time interval, wherein the first and second measuring means each includes:

(a) means for generating a ramp signal having an amplitude that varies linearly with respect to time at a desired rate, (b) means for starting the ramp signal at a predetermined time after detection of the respective boundaries of the sample time interval, (c) means for stopping the ramp signal at a predetermined time after the start of the clock period that immediately follows the respective boundaries of the sample time interval, and (d) means for determining the duration between the start and stop of the ramp signal, wherein such duration is representative of the respective first and second time periods;

means for correcting the approximate value of the sample time interval as represented by the output of the counter using the measured first and second time periods to provide a more accurate representation of the sample time interval; and means for automatically calibrating the first and second measuring means to maximize the accuracy of measurement of the first and second time periods.

2. A system according to claim 1 wherein the input signal includes a plurality of sample time intervals and further comprising means for randomly omitting sampling of some of the sample time intervals.

3. A system according to claim 1 wherein the means for determining the duration of the ramp signal includes ramp measuring means for measuring the amplitude of the ramp signal at the stop of the ramp signal and for producing an output indicative of the corresponding first or second time period in response to the measured amplitude, said amplitude being representative of the duration of the ramp signal.

4. A system according to claim 3 wherein the calibration means comprises:

ramp adjustment means for adjusting the rate of amplitude variation in the ramp signal; and measurement adjustment means for adjusting the ramp measuring means to vary its output response to the measured amplitude of the ramp signal, wherein the amplitude variation rate is adjusted so that the range of amplitude of the ramp signal corresponds to the range of value of the respective first and second time period and that the range of output of the ramp measuring means corresponds to such range of amplitude of the ramp signal.

5. A system according to claim 4 further comprising:

means for providing a test signal as the input signal, the test signal having a predetermined frequency and the test signal is asynchronous to the clock signal, wherein the asynchronism between the test signal and the clock signal generates an even distribution of different sizes of first and second time periods; and control means for controlling the adjustments of the first and second measuring means independently of one another and for controlling the ramp adjustment means and measurement adjustment means independently of one another in each measuring means, each adjustment being made in iterative steps wherein after each step, results of the respective first and second time periods measured are compared to the expected results to determine if a calibration status has been reached at which time the adjustment is stopped.

6. A system according to claim 3 wherein the ramp measuring means includes an analog-to-digital converter which receives the ramp signal and whose output is representative of the corresponding first or second time period.

7. A system according to claim 6 wherein the means for correcting the approximate value of the sample time interval comprises:

means for combining the outputs of the analog-to-digital converters representative of the first and second time periods to provide a net correction value to be used to correct the approximate value of the sample time interval as provided by the counter; and means for conjoining the net correction value with the output of the counter, wherein the conjoint number is representative of the value of the sample time interval.

8. A system according to claim 7 wherein the input signal includes a plurality of sample time intervals and further comprising means for counting number of occurrences of sample time intervals of the same value for each different value.

9. A system according to claim 8 wherein the counter includes:

memory means for storing the numbers representative of the occurrences of the time intervals of the same value for each value, said memory means having memory locations each designated to store data corresponding to one value of the time intervals;

means for addressing a particular memory location using the conjoined number; and means for incrementing the number in the memory location when it is addressed.

10. A method for time interval measurement comprising the steps of:

providing an input signal defining at least one sample time interval;

generating a clock signal having a predetermined frequency wherein each clock period is defined to start at a predetermined reference amplitude of the clock signal;

determining the beginning and end of the sample time interval;

incrementing a counter at each start of the clock period that occurs during the interval between the beginning and end of the sample time interval, the result being representative of an approximate value of the sample time interval;

measuring a first time period between the beginning of the sample time interval and the start of the clock period that immediately follows the beginning of the sample time interval;

measuring a second time period between the end of the sample time interval and the start of the clock period that immediately follows the end of the time interval, wherein the steps for measuring the first and second time periods include:

(a) gathering a ramp signal having an amplitude that varies linearly with respect to time at a desired rate, (b) starting the ramp signal at a predetermined time after the respective boundaries of the sample time interval, (c) stopping the ramp signal at a predetermined time after the start of the clock period that immediately follows the respective boundaries of the sample time interval, and (d) determining the duration of the ramp signal defined between the start and stop of the ramp signal, such duration is representative of the respective first and second time periods;

correcting the approximate value of the sample time interval using the measured first and second time periods; and automatically modifying the steps of measuring the first and second time periods to maximize the accuracy of subsequent measurements.

11. A method according to claim 10 further comprising the step of:

providing a test signal as the input signal;

wherein the test signal is used in said step of modifying the first and second time periods.

12. A method according to claim 11 wherein first and second analog-to-digital converters are employed to receive the ramp signal and provide a digital output representative of the first and second time periods, respectively, and wherein the steps of measuring the first and second time periods are modified by the steps comprising:

adjusting the rate of amplitude variation in the ramp signal; and adjusting the respective analog-to-digital converter corresponding to the first and second time periods to vary its output response to the measured amplitude of the ramp signal, wherein the amplitude variation rate is adjusted so that the range of amplitude of the ramp signal corresponds to the desired range of value of the respective first and second time periods and so that the range of output of the analog-to-digital converters corresponds to such range of amplitude of the ramp signal.

13. A method according to claim 12 wherein the test signal is of a predetermined frequency asynchronous to the clock signal thereby to provide an even distribution of different sizes of first and second time periods, and wherein the adjustment of the analog-to-digital converter and the adjustment of the rate of amplitude variation in the ramp signal are independently controlled, each adjustment being made in iterative steps wherein after each step, results of the respective first and second time periods measured are compared to expected results to determine if a calibration status has been reached at which time the adjustment is stopped.

14. A method according to claim 10 wherein the step of determining the duration of the ramp signal includes measuring the amplitude of the ramp signal at the stop of the ramp signal which is representative of the duration of the ramp signal.

15. A method according to claim 14 wherein the amplitude of the ramp signal is measured using an analog-to-digital converter so as to represent the first and second time periods in digital form.

16. A method according to claim 15 further comprising the steps of:

combining the outputs of the analog-to-digital converters representative of the first and second time periods to provide a net correction value to be used to correct the approximate value of the sample time interval; and conjoining the net correction value with the approximate value of the sample time interval obtained by the counter, wherein the conjoint number is representative of the value of the sample time interval.

17. A method according to claim 16 wherein the input signal includes a plurality of sample time intervals and the method further comprising the step of counting number of occurrences of sample time intervals of the same value for each different value.

18. A method according to claim 17 wherein the counting step comprises the steps of:

storing numbers representative of the occurrences of the time intervals of the same value for each value in a memory having memory locations each designated to store data corresponding to one value of the time intervals;

addressing a particular memory location using the conjoint number; and incrementing the number in the memory location when it is addressed.

* * * * *